United States Patent [19]

Prior

[11] Patent Number: 4,652,341

[45] Date of Patent: Mar. 24, 1987

[54] ACCELERATED PULPING PROCESS

[76] Inventor: Eric S. Prior, 830 Signal Way, Coos Bay, Oreg. 97420

[21] Appl. No.: 387,350

[22] Filed: Jun. 11, 1982

Related U.S. Application Data

[63] Continuation of Ser. No. 176,182, Aug. 7, 1980, abandoned, and a continuation-in-part of Ser. No. 74,658, Sep. 12, 1979, abandoned, which is a continuation-in-part of Ser. No. 20,978, Mar. 16, 1979, abandoned, which is a continuation of Ser. No. 855,754, Nov. 29, 1977, abandoned, which is a continuation-in-part of Ser. No. 699,189, Jun. 23, 1976, abandoned, which is a continuation-in-part of Ser. No. 699,188, Jun. 23, 1976, abandoned.

[51] Int. Cl.[4] ..... D21C 3/04

[52] U.S. Cl. ..... 162/79; 162/81; 162/90

[58] Field of Search ..... 162/4, 7, 8, 10, 11, 162/12, 16, 19, 25, 28, 37, 38, 40, 41, 42, 45, 79, 80, 81, 82, 90, 94, 96, 97, 91, 163, 98, 99; 71/23, 25, 64 E, 64 SC; 260/17.5, 124 R; 106/123 R, 123 LC, 213, 214, 236, 242, 287 SS; 405/263, 264; 426/635, 636, 807; 210/702, 710, 711, 723, 767, 768

[56] References Cited

U.S. PATENT DOCUMENTS

| | | | |
|---|---|---|---|
| 322,882 | 7/1885 | Young et al. | 162/81 |
| 1,634,603 | 7/1927 | Wood | 162/11 |
| 1,716,623 | 6/1929 | Collins et al. | 162/11 |

List Continued on next page.

OTHER PUBLICATIONS

Sinai et al., "Separation of Sugars & Lignin in Spent Sulfite Liquor by Hydrolysis & Ultrafiltration", TAPPI, 59(3), 3-1976, pp. 112-114; 162-216.

Casey, *Pulp & Paper,* vol. I, 1960, pp. 370-371, Gp 170.

*Primary Examiner*—Arthur L. Corbin

*Attorney, Agent, or Firm*—Bernard, Rothwell & Brown

[57] ABSTRACT

A process of treating fibrous ligno-cellulose material to form defibered chemical cellulose pulp suitable, for example, for the manufacture of paper and paperboard and dissolving pulp and to treat defibered ligno-cellulose material to produce basic animal feed or packaging and building boards.

The process is based on the nitration and dissolving of the lignin component of the cellulose material either in an alkaline solution or with a two step operation in which the nitration can be in an acid stage comprising the step of submerging the fiberous ligno-cellulosic material in aqueous nitric acid having an $HNO_3$ concentration in the range of about 0.125 to 9 weight percent, followed by an alkaline stage to dissolve out the nitrated lignin from the fibrous structure. In the production of chemical pulp or animal feed the lignin containing solution (black liquor) is separated from the cellulose material.

The time required for nitration is substantially shortened by including in the nitrating solution aluminum compounds, e.g., aluminum salts of inorganic acids such as aluminum sulfate, aluminum chloride, aluminum phosphate or aluminum nitrate, preferably aluminum sulphate, i.e., papermaker's alum, in an amount sufficient to achieve an equivalent aluminum ion concentration in the pulping liquor, preferably about 0.065 to 0.105 parts by weight of aluminum sulphate for each 10 parts by weight of nitrate ion in the nitrating solution.

The nitrating liquor including wash water, either acid or alkaline, can be recycled to nitrating chemical exhaustion. Lignin-containing extraction liquor is recycled to build up the percentage of lignin solids and systematically purged. Part or all of the ligneous component may be recombined with the cellulosic pulp produced with which it acts as a retention agent, binder, water repellant and stiffening agent. In combination with defibered ligno-cellulosic materials its function is as a binder and hydrophilic material.

For grassy, fibrous ligno-cellulosic materials (i.e., straw) nitrate salts such as the alkali salts $NaNO_3$, $KNO_3$, or $NH_4NO_3$, which have a relatively lower ionizing factor than nitric acid, can be used in an alkaline solution to nitrate and dissolve the ligneous component. The use of nitrates in an alkaline solution for woody fibrous materials (i.e., spruce wood chips) requires additional pulping time than if an aggressive acid nitrate source is used for nitration.

21 Claims, 20 Drawing Figures

U.S. PATENT DOCUMENTS

| | | | |
|---|---|---|---|
| 1,717,199 | 6/1929 | Marr | 162/79 X |
| 1,829,852 | 11/1931 | Darling | 162/81 X |
| 2,110,545 | 3/1938 | Dreyfus | 162/81 |
| 2,269,985 | 1/1942 | Olsen | 162/79 |
| 2,332,369 | 10/1943 | Burton | 162/163 X |
| 2,562,898 | 8/1951 | Evans et al. | 162/163 X |
| 2,615,883 | 10/1952 | Sweeney et al. | 162/81 X |
| 2,731,344 | 1/1956 | McKee | 162/11 |
| 3,305,435 | 2/1967 | Williston et al. | 162/163 X |
| 3,463,699 | 8/1969 | Broadhead et al. | 162/163 |
| 3,576,709 | 4/1971 | Menzies | 162/16 |
| 3,578,553 | 11/1971 | Godsay et al. | 162/81 X |
| 3,725,029 | 4/1973 | Blackmore | 71/64 E X |
| 3,881,986 | 5/1975 | Backlund | 162/41 X |
| 3,929,558 | 12/1975 | Shaw | 162/79 X |
| 4,048,341 | 9/1977 | Lagerstrom et al. | 426/636 X |

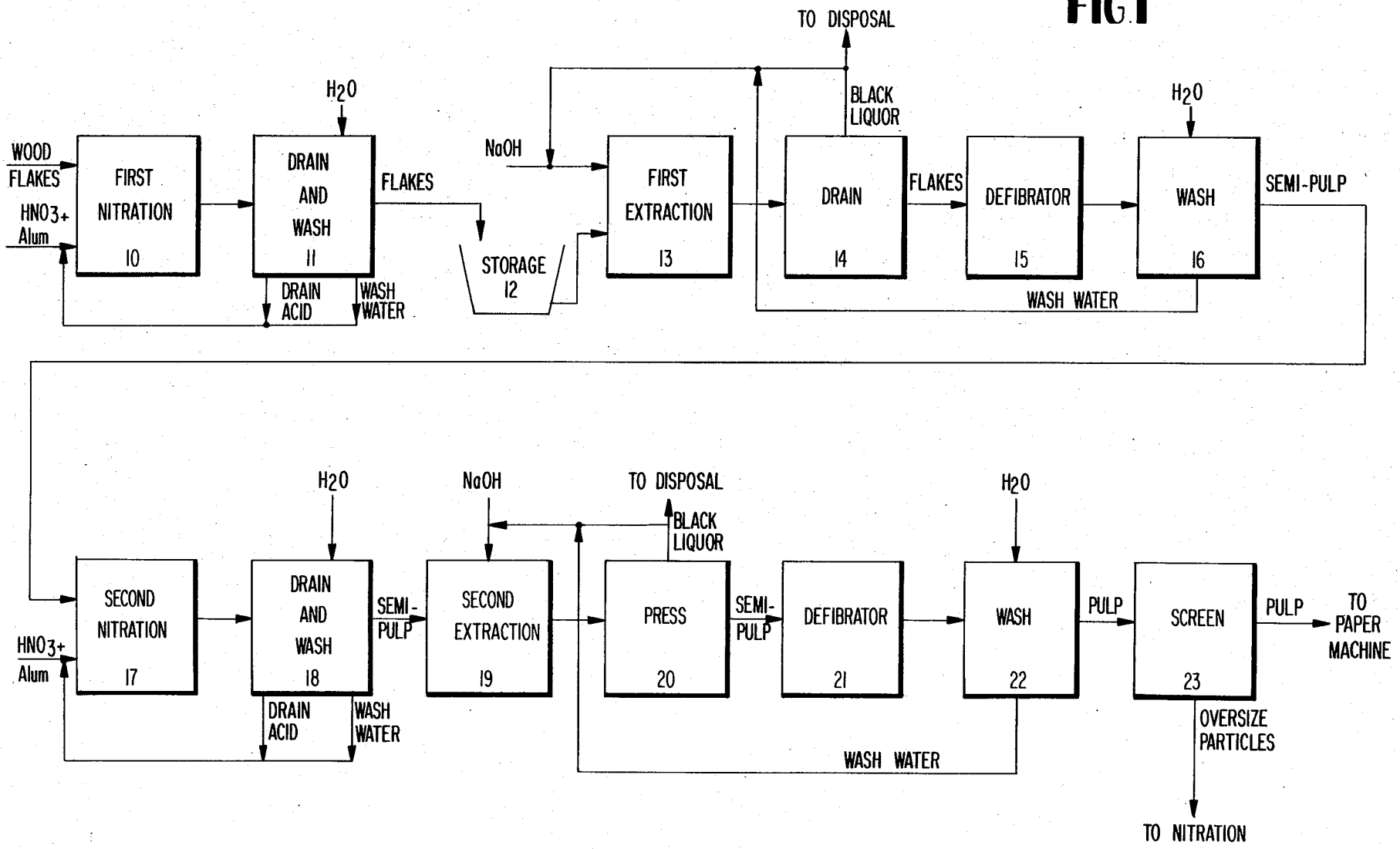
FIG. 1
WOOD FLAKES
HNO3+ Alum
FIRST NITRATION 10
H2O
DRAIN AND WASH 11
DRAIN ACID
WASH WATER
FLAKES
STORAGE 12
NaOH
FIRST EXTRACTION 13
TO DISPOSAL
BLACK LIQUOR
DRAIN 14
FLAKES
DEFIBRATOR 15
WASH WATER
H2O
WASH 16
SEMI-PULP
HNO3+ Alum
SECOND NITRATION 17
H2O
DRAIN AND WASH 18
DRAIN ACID
WASH WATER
SEMI-PULP
NaOH
SECOND EXTRACTION 19
TO DISPOSAL
BLACK LIQUOR
PRESS 20
SEMI-PULP
DEFIBRATOR 21
WASH WATER
H2O
WASH 22
PULP
SCREEN 23
OVERSIZE PARTICLES
TO NITRATION
PULP
TO PAPER MACHINE

ORGANIC FIBER PULPING

PAPER WASTE PULPING

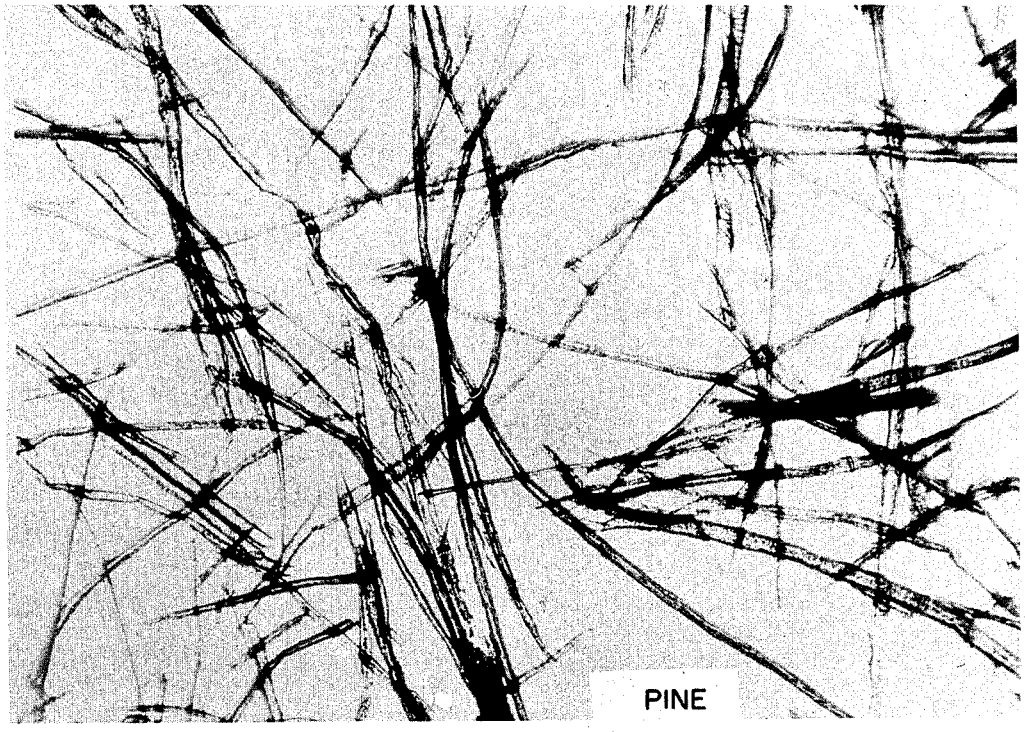
FIG. 2
mm
0 1
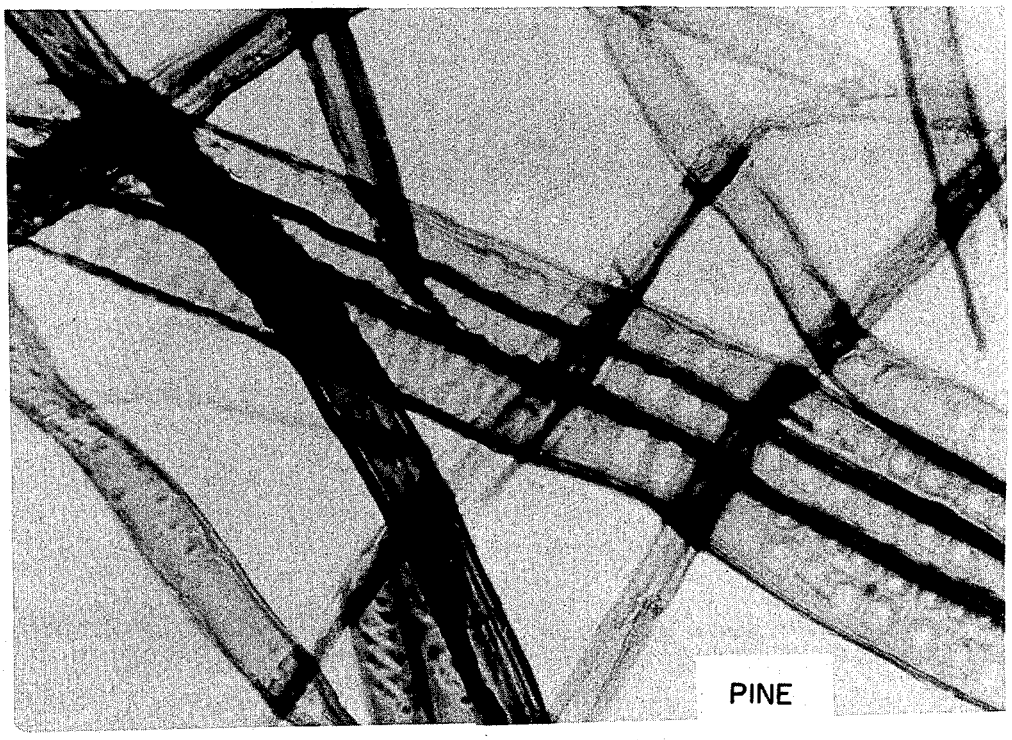
FIG. 3
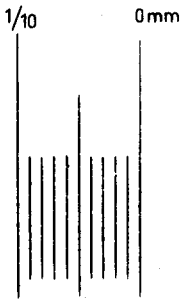

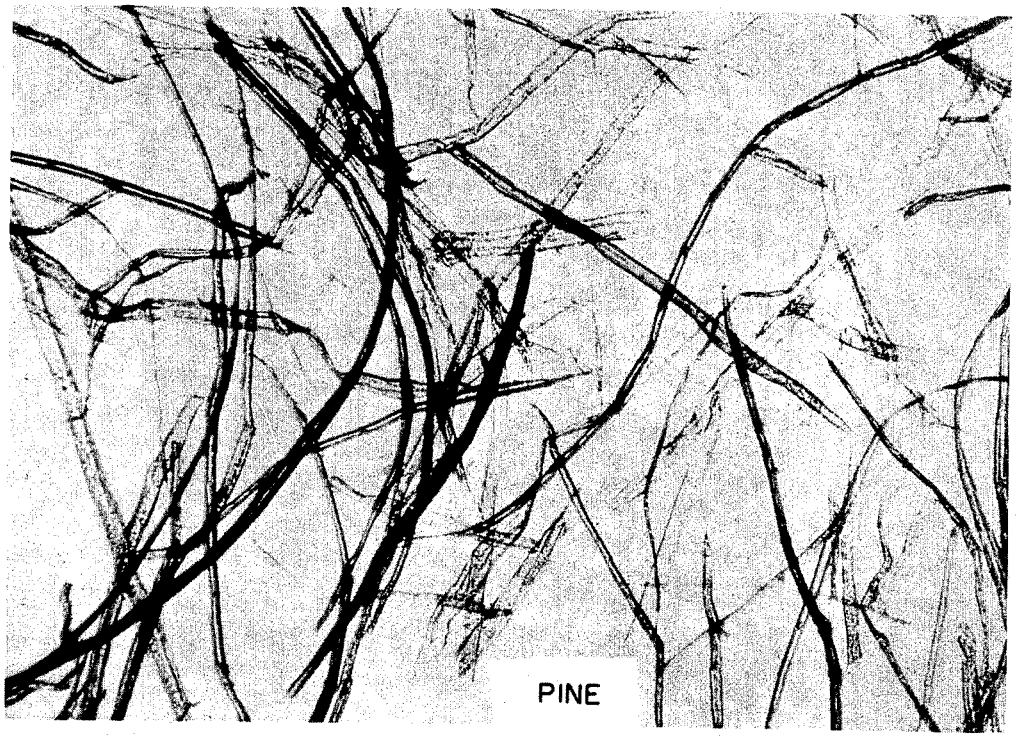
FIG. 4
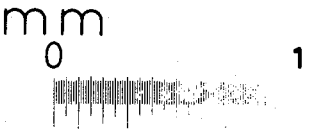
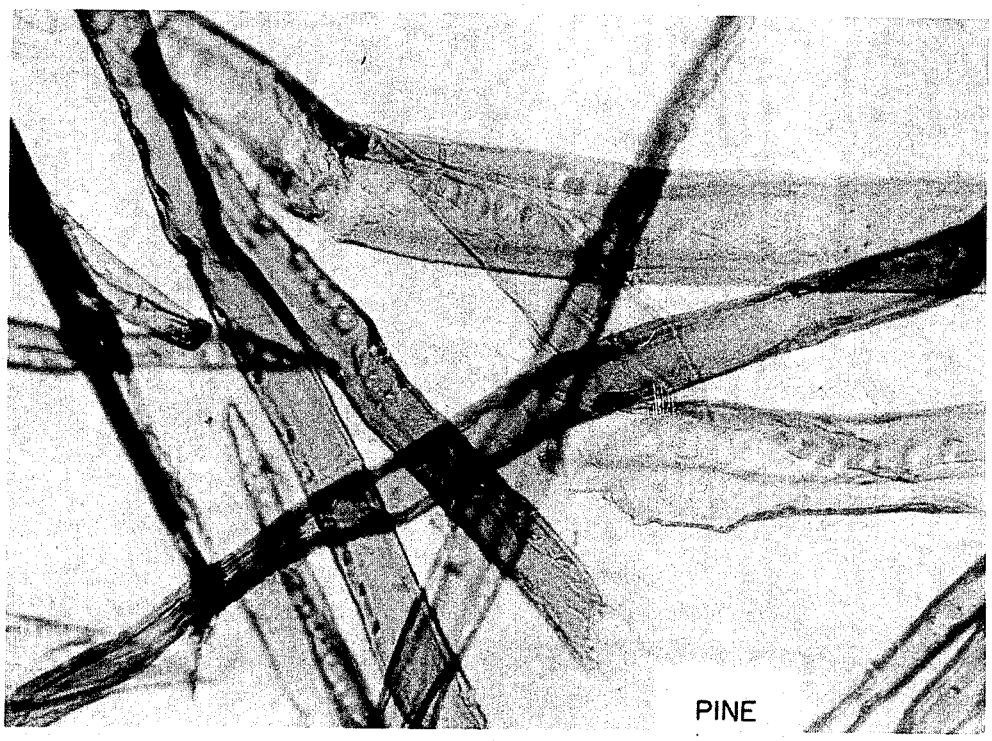
FIG. 5
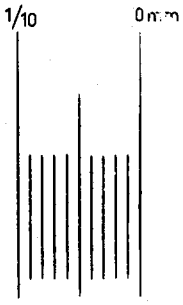

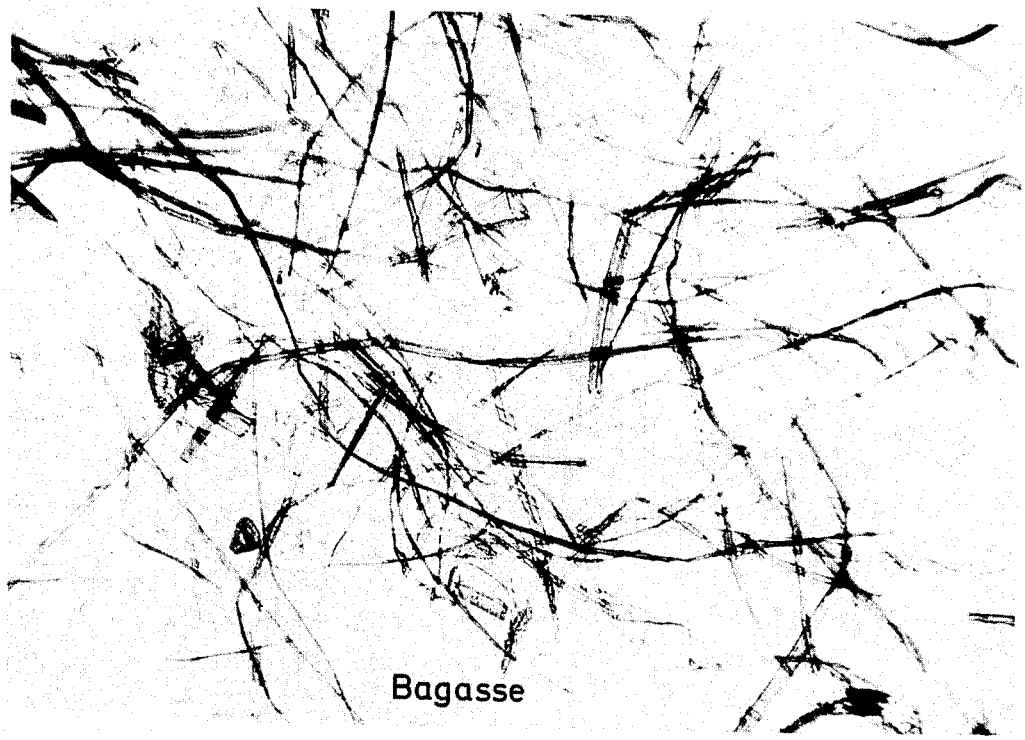
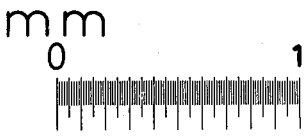
FIG. 8
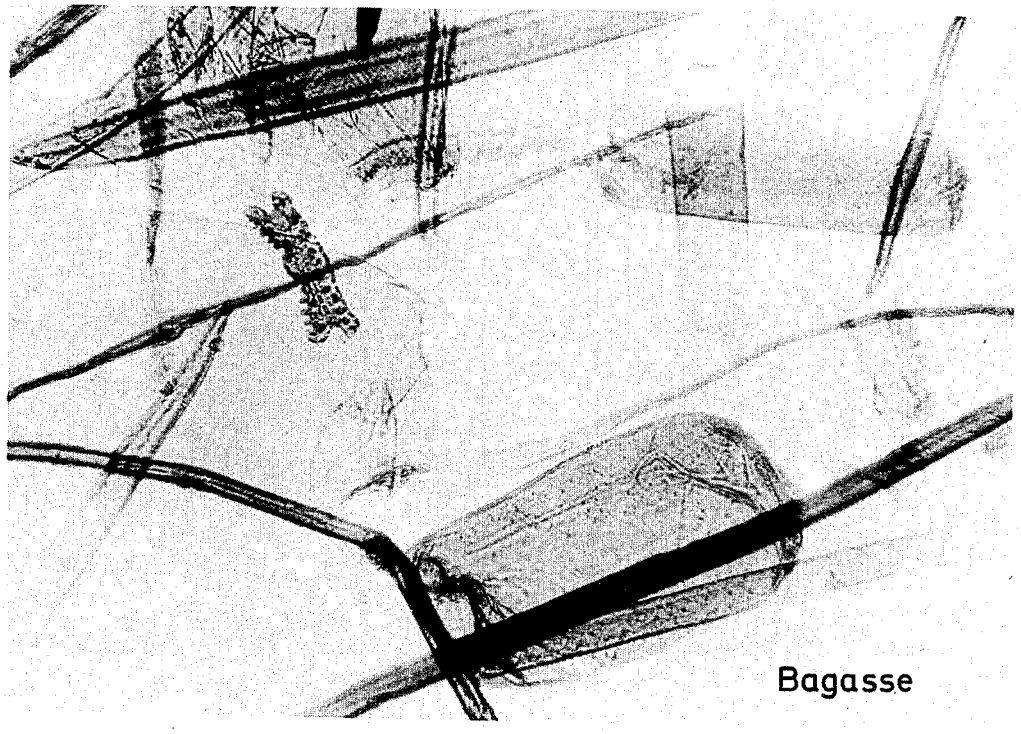
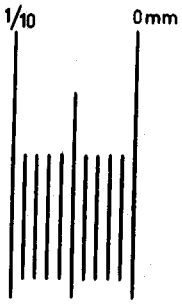
FIG. 9

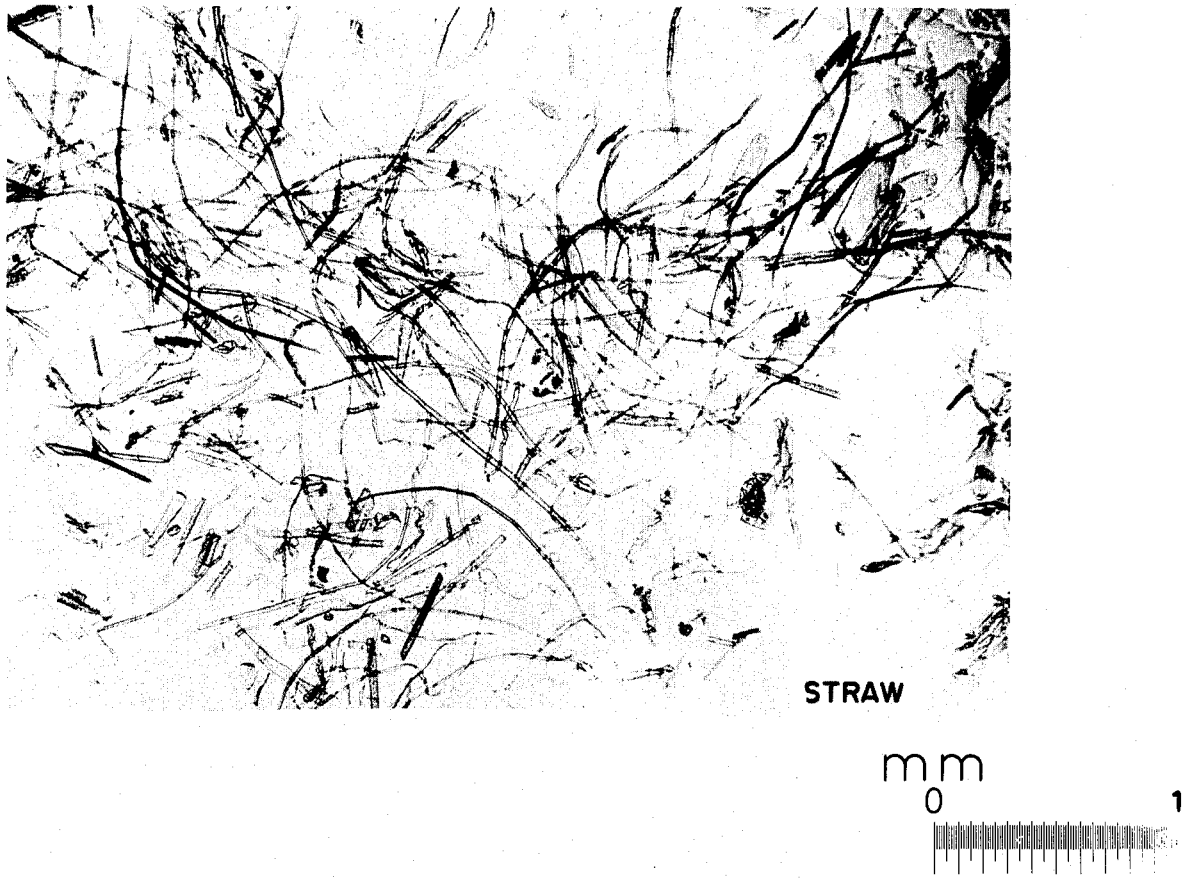
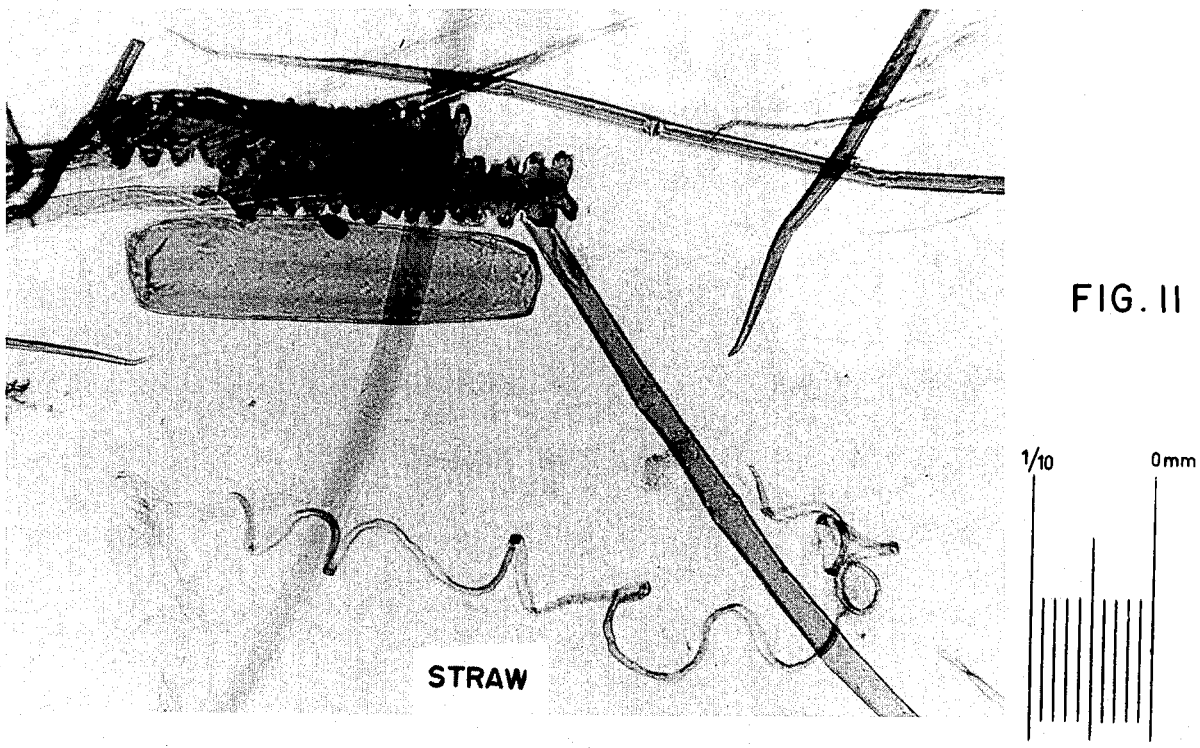
FIG. 11

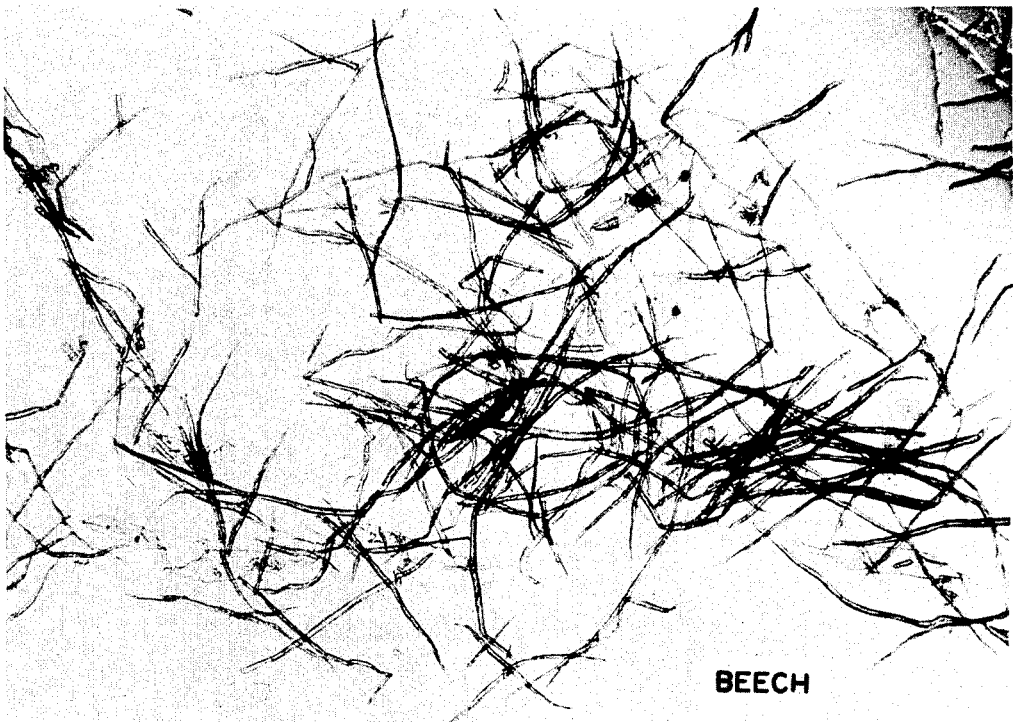
FIG. 12
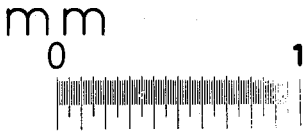
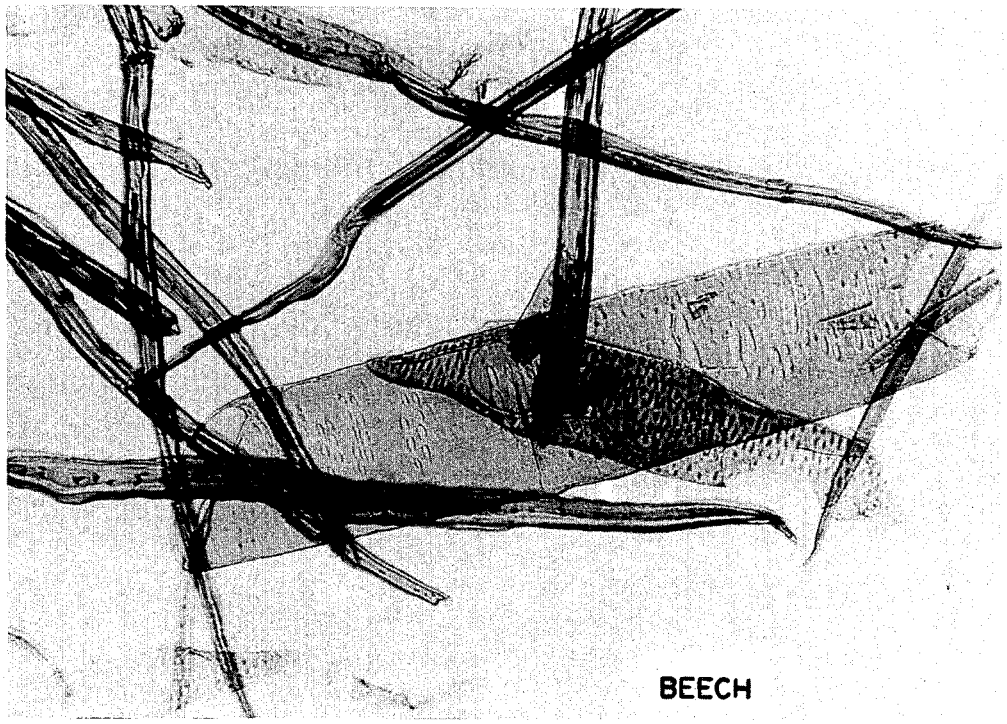
FIG. 13
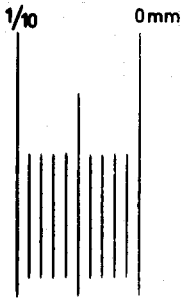

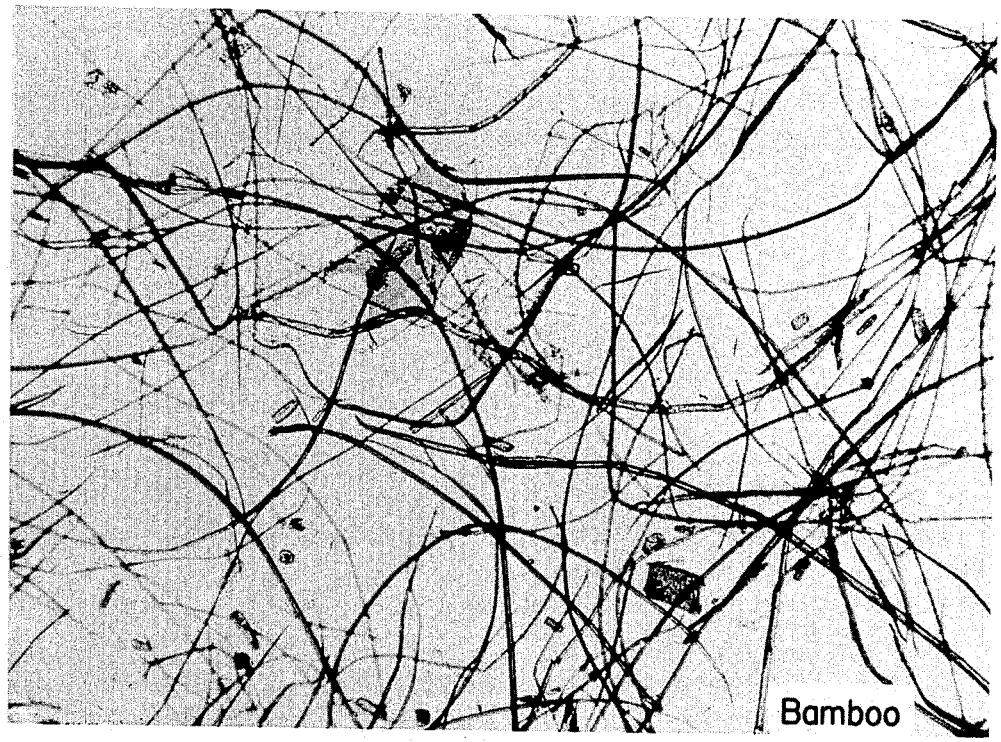
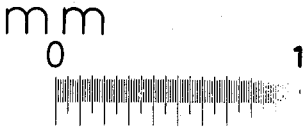
FIG. 14
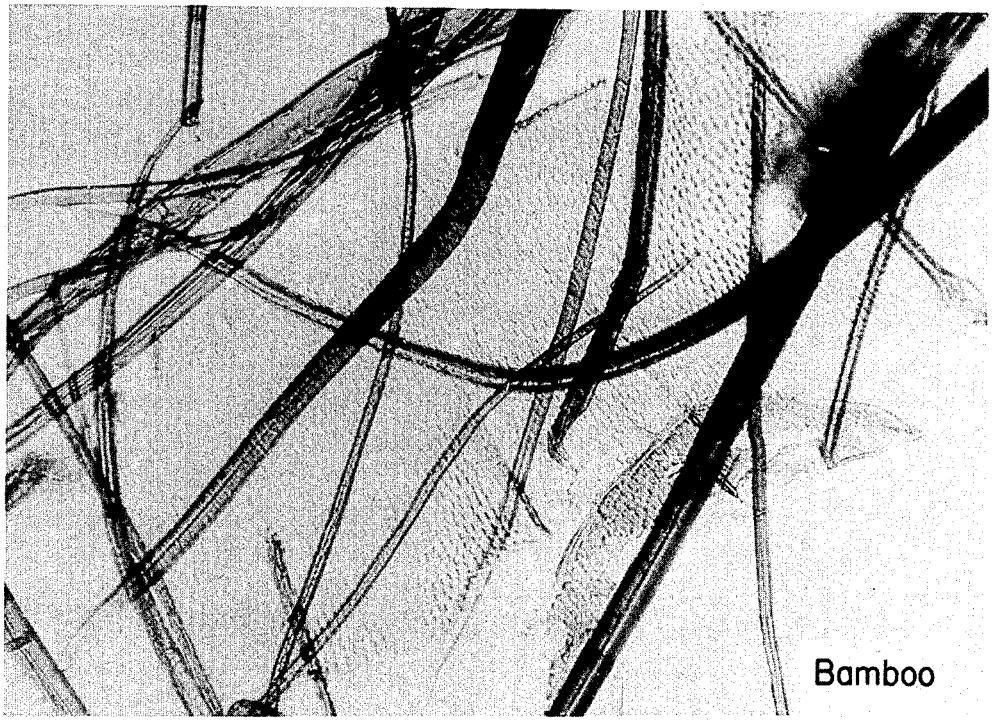
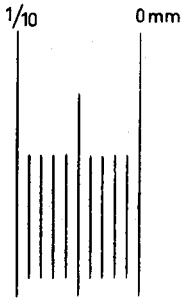
FIG. 15

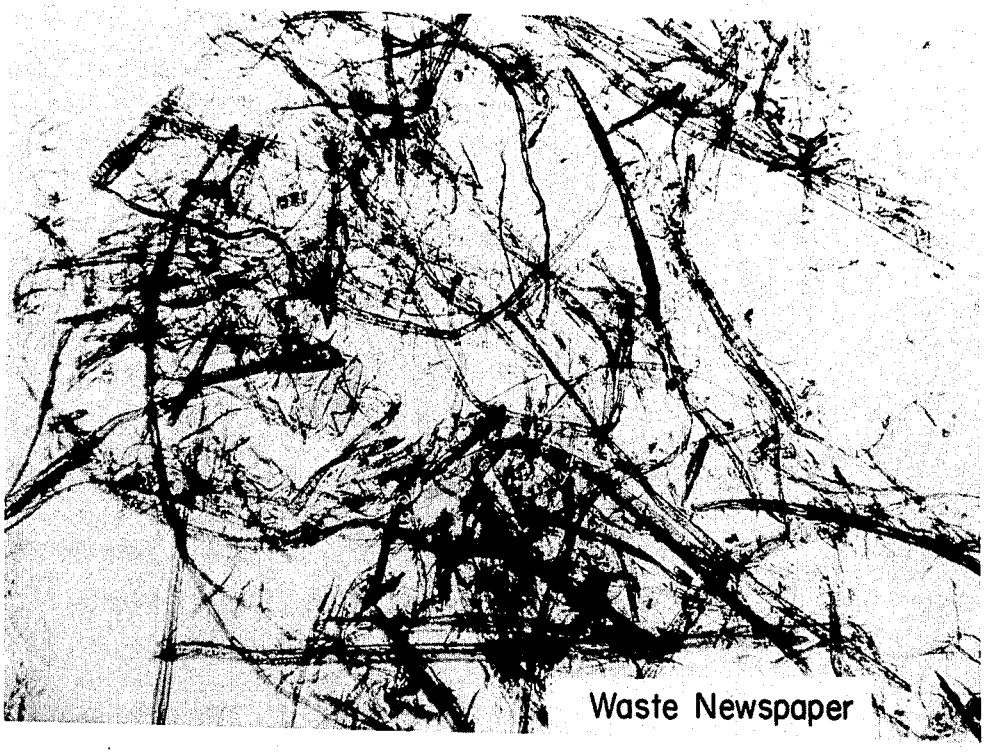
FIG. 16
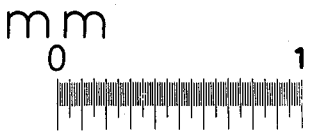
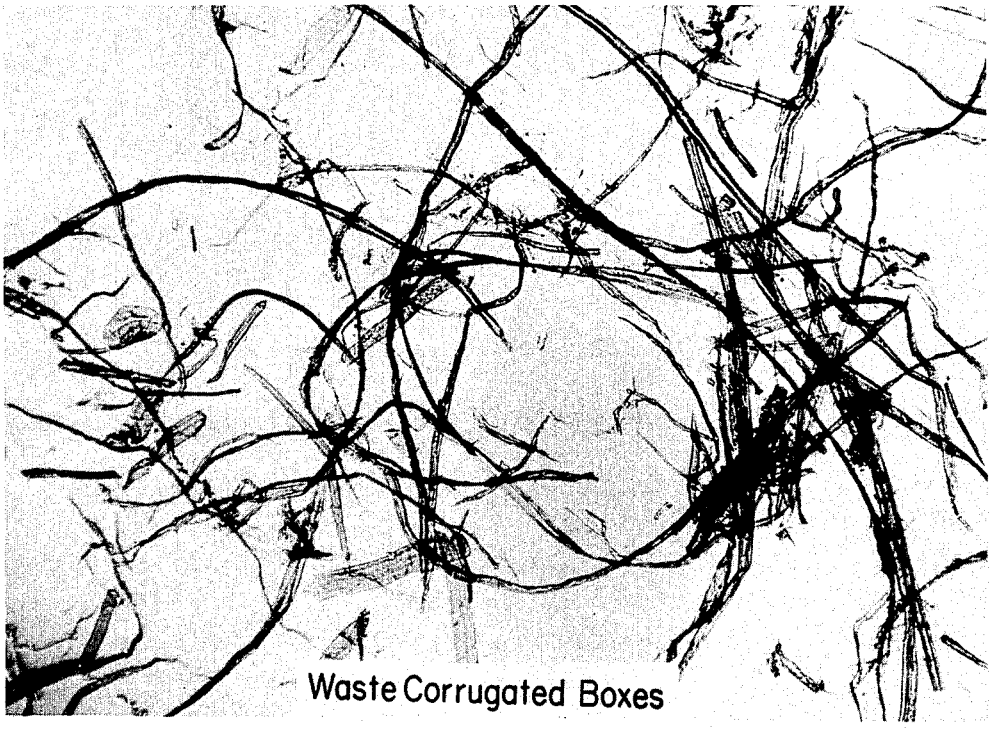
FIG 17
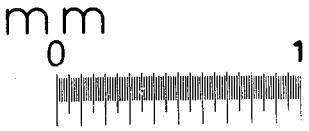

ACCELERATED PULPING PROCESS

This is a continuation of application Ser. No. 176,182 filed Aug. 7, 1980, which is a continuation-in-part of application Ser. No. 74,658 filed Sept. 12, 1979, which is a continuation-in-part of application Ser. No. 20,978, filed Mar. 16, 1979, which is a continuation of application Ser. No. 855,754, filed Nov. 29, 1977, which in turn is a continuation-in-part of application Ser. No. 699,189, filed June 23, 1976 and application Ser. No. 699,188, filed June 23, 1976 all now abandoned.

This invention relates to an improved process of breaking the lignin bond of fibrous materials in a form ranging from that of a moderately digested product for animal feed to pulps that can be utilized as chemical or semi-chemical pulp for packaging papers and boards, bleachable pulps for white papers, highly purified pulp for dissolving pulp and to simply develop surface unbonded lignin on fibrous material to act as a binder.

The invention relates to a lignin nitration pulping process in which the nitration can be carried out either in an acid or alkaline solution, and the time for nitration is substantially shortened by the inclusive use of aluminum compounds.

This invention also relates to a pulping process in which the ligneous components extracted from ligno-cellulose raw material is recombined with the pulped fibers to provide added strength characteristics for packaging papers and paperboards or to act as a binder for defibered ligno-cellulosic material.

The use of the inherent flexibility of the process time, temperature and chemical concentrations permits controlled delignification and defibering to produce animal feed, building board, packaging board and paper, bleached papers and dissolving pulp.

The potential use of nitrate containing chemicals, specifically nitric acid, as a specific pulping agent for cellulosic structures has been recognized for many years. The processes varied widely in time and acid concentration and were mostly applied to the very easily pulped fibrous structures such as straw or slivered wood or hardwoods. The processes depended on partial nitration, final oxidation and subsequent hydrolysis of the lignin structure—the acid consumption was high and the fiber produced had brittle characteristics. In such a process producing a chemical type pulp, recovery of chemical remains unsolved.

So far as I am aware, pulping processes using nitric acid have never been commercially successful. The following excerpts from patents granted or suggested processes on easily pulped fibrous materials are indicative of the scope and problems (sometimes hazardous) involved in such processes where high acid concentrations and usage with lengthy process times make commercial practice unworkable and uneconomic with no conceivable advantages over present day conventional processes.

Casey—*Pulp & Paper,* Vol. I

| Nitric Acid Pulping of Poplar Wood | Patentee | | |
|---|---|---|---|
| | Dreyfuss | Miles | Solechnik |
| Acid Concentration (%) | 6 | 8 | 7 |
| Time of Digestion (hours) | 3 | 9 | 1.5 |
| Temperature (°C.) | 80 | 100 | 98 |

-continued

| Nitric Acid Pulping of Wood Wafers (1/100 inch thick) | |
|---|---|
| Acid Concentration (%) | 42 |
| Acid Temperature (°C.) | 68 |
| Acid Consumption/Ton Pulp | 15% |
| Nitric Acid Pulping of Bagasse | |
| Acid Concentration (%) | 5 |
| Cooking Time (hours) | 1.0 |
| Cooking Temperature (°C.) | 80 |
| Acid Consumption/Ton Pulp | 15% |
| Nitric Acid Pulping of Straw | |
| Acid Concentration (%) | 2–6.0 |
| Cooking Time (hours) | 4–6.0 |
| Cooking Temperature (°C.) | 90 |
| Alternatively | |
| Acid Concentration (%) | 42.0 |
| Cooking Time (hours) | 4.0 |

In my process chemical concentrations are lower, processing time greatly reduced and nitrating chemical consumption does not exceed 5.5% on pulp yield.

SUMMARY OF THE INVENTION

The present invention relates to a process for treating fibrous ligno-cellulose material to form defibered chemical cellulose pulp. The process comprises contacting said ligno-cellulose material with an aqueous solution of a nitrate ion source to nitrate the ligneous component of said material, contacting the nitrated material produced in step (a) with an alkaline extraction liquor to extract the nitrated ligneous component to provide softened, partially defibered cellulosic structures, and completely defibering said partially defibered cellulose material wherein an aluminum compound is added to the solution of the nitrate ion source in an amount sufficient to accelerate the nitration of the lignin and the process is carried out at atmospheric pressure and at temperatures below about 110° C.

BRIEF DESCRIPTION OF THE DRAWINGS

FIG. 1B is a diagram which illustrates a process for the pulping of wood flakes.

FIGS. 2–17 represent electron micrographs of various cellulosic fibers produced by the process of the present invention.

FIG. 18 illustrates a simple process involving a modified hydrapulper for the production of pulp for paper. FIG. 19 illustrates a unit for the production of animal feed and paper pulp.

DETAILED DESCRIPTION OF THE INVENTION

Figure 1:
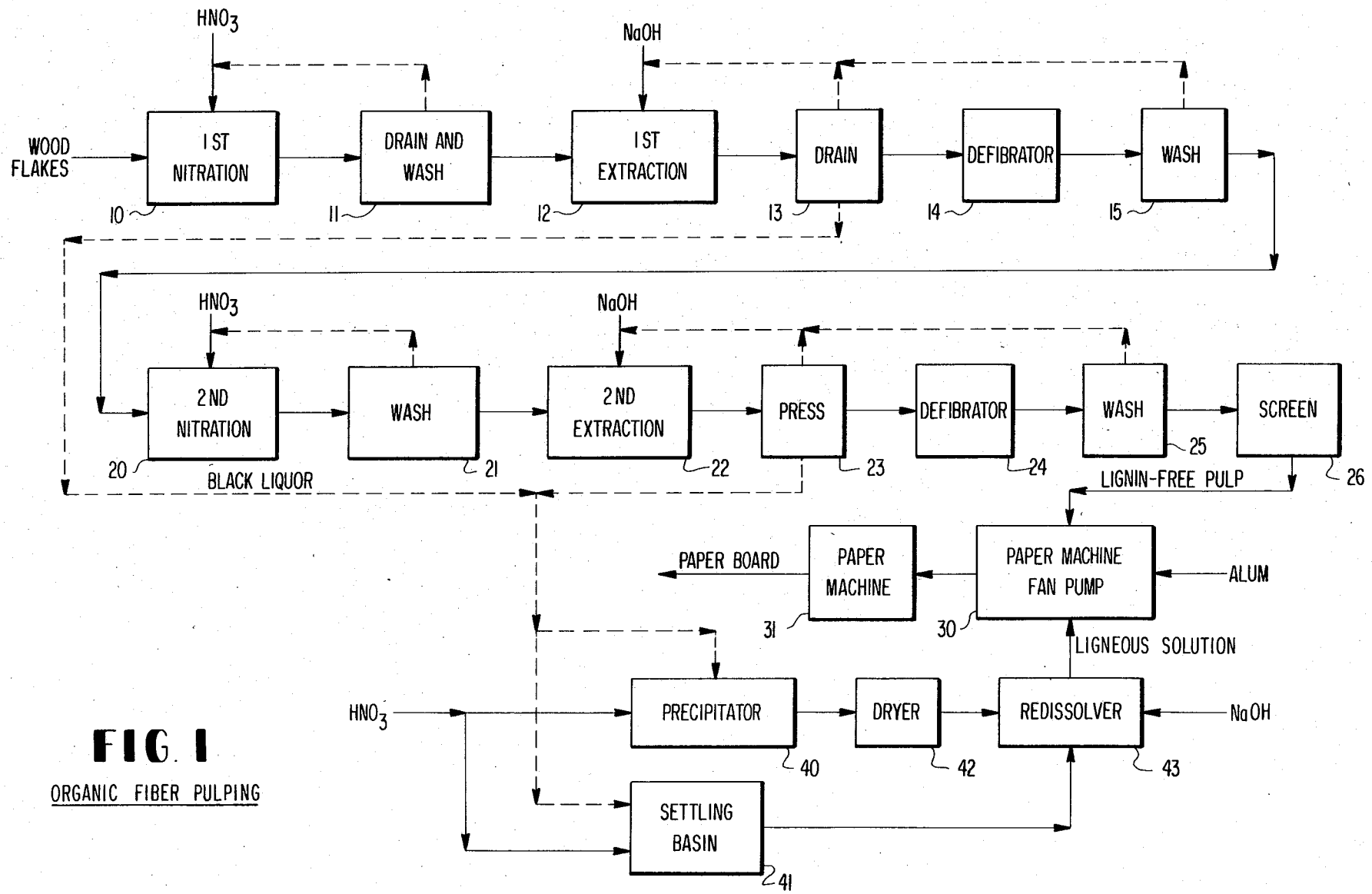
FIG. 1 is a diagram which illustrates a process for converting wood flakes to pulp.

The pulping process of the present invention is based on the nitration of the lignin molecule, which is not soluble in an acid solution, using a variety of chemicals as the nitrating agent, either acid or nitrate salts, and making said nitrated lignin soluble in an alkaline solution, either in one or two steps, under conditions of atmospheric pressure and temperatures below 100° C., in times substantially lower than conventional chemical pulp processes.

Nitrates can be advantageously used in an alkaline solution for pulping straw in one hour at 70° C. using a concentration of 0.0125% nitrate ions in an alkaline solution of pH 13.5 using either $NH_4NO_3$ or $HNO_3$ as nitrate sources, modified with aluminum sulphate as previously described. Board made with such process characteristics is equivalent in test and performance values to semi-chemical board made by conventional NSSC pulping processes at high pressures (125 psi) and temperature (175° C.) from wood chips in 15–20 minutes. Nitric acid added as a nitrate source in the delignification of spruce wood chips in a concentration of 0.025% in an alkaline solution (pH 13.5) produces a chemical type pulp of medium strength in 1.5 hours at atmospheric pressure and at 100° C. The pulp is light in color with a Kappa No. of 125.

To reduce the time of processing, and to obtain pulp of higher purity (i.e., less lignin) and higher strength characteristics, it is advisable to use $HNO_3$ with $Al_2(SO_4)_3$—$18H_2O$ as an accelerator as a nitrate ion source in an acid step followed by alkaline extraction of the lignin. In this approach the nitrate ion concentration will vary from about 0.125–9 weight percent nitric acid, for example, about 0.15–5 or more and preferably about 0.125 or 0.15–1.5% for pulping straw and about 2.5%–5 weight percent for pulping wood dependent on species cooked and pulp purity desired.

Spruce chips, for example, can be cooked to a high strength pulp and Kappa No. 75 with a nitrate ion concentration of 3.8 weight percent in the cooking liquor.

The nitrate ion used in contacting the dry cellulose material can usually vary from a minimum of about 0.125 weight percent in the case of straw to a maximum of about 9 but preferably not more than about 5.5 weight percent, in the case of wood. Actual usage of nitrating chemical with recycling does not usually exceed 5.5% and alkali usage—again with recycling of the black liquor—is usually about 4–6%. Together, this total chemical usage compares favorably with the make-up chemicals used in the kraft process where full, expensive and complicated, chemical recovery is practiced.

Since the cooking liquors of this invention are simple solutions of purchased or off-the-shelf chemicals, no complex system of liquor manufacture or control is necessary, and the low concentrations and recycling capability make for low usage and cost and elimination of a recovery system.

Where the black liquor that is purged is desired as a source of energy rather than be recombined with the pulp, it can of course follow the conventional system in which the recovery boiler uses the heat of combustion of the lignin to recover chemicals and provide process heat.

Conventional pulp mills require large capital investment due to the minimum size that is economic (250 tons of pulp per day), to the high temperatures and pressures involved and the absolute need to recover and mix the complex cooking chemicals. Further, substantial investment is required for both air and water pollution control. The process of this invention uses simple chemicals, does not require either vacuum or superatmospheric pressure or temperatures over 100° C., offers minimal and easily avoidable problems of air and water pollution and offers high value usability of the ligneous products of pulping, normally disposed of by burning or wasted by dumping.

I have now also discovered that in the chemical pulping process involving nitration of particulate, fibrous ligno-cellulose raw material with various sources of nitrate ions, which may be coincidental with or followed by an alkaline extraction from the material of the nitrated lignin, leaving softened, partially defibered cellulosic structures which can further be completely defibered by normal mechanical means, the total time required for nitration/extraction can be substantially shortened by including a proportionate amount of aluminum compounds in the nitrating solution. While the precise time required for the nitration/extraction process, either simultaneous or sequential, is dependent upon the variables of particle thickness, temperature and reagent concentration, it can be said for the process of the present invention that total process time is greatly reduced. For example, for chemical type high yield wood pulps from coniferous wood chips, the total process time is 90 minutes using atmospheric pressure and temperatures not exceeding 100° C. This time is to be compared with conventional sulphite process time of 6–7.50 hours and the sulphate kraft process of 2.5–5.0 hours at high pressure and temperatures as set forth in the following Table 1:

TABLE 1

| | PULPING PROCESSES COMPARED | | | | |
|---|---|---|---|---|---|
| | Liquor Concentration wt. % | Total Cooking Time | Temperature °C. | Pressure P.S.I.G. | Fiber Species |
| 1. Casey, "Pulp and Paper", Vol. 1 p. 169 | | | | | |
| Sulphite - Bleach Grade | | | | | |
| Calcium Base | 6.0 | 6.25 Hrs. | 140 | 80 | Western |
| Amonia Base | 6.0 | 7.50 Hrs. | 146 | 80 | Conifer |
| 2. Casey, pp. 230–264 | | | | | |
| Sulphate - High Yield | 18.5 | 2.50 Hrs. (1) | 170 | 140 | U.S. |
| Sulphate - Bleachable | 22.0 | 5.00 Hrs. (1) | 160 | 100 | Southern Pine |
| (1) includes time to bring to temperature | | | | | |
| 3. TAPPI CA Report, 52, pp. 17–19 | | | | | |
| Bagasse - Soda Process | 6.5 | 26.50 Min. (2) | 170 | 114 | Bagasse |
| (2) includes cooking time in blow tank | | | | | |
| 4. TAPPI CA Report 52, pp. 26–27 | | | | | |
| Bamboo - Kraft Process | 17–19 | 1.25 Hrs. | 150 | 85 | Bamboo |
| 5. Accelerated Pulping - Sequential Process | | | | | |
| Examples (Invention) | $HNO_3$ NaOH | | | | |
| High Yield Pulp | 5.5/0.3 | 90 Min. | 85–100 | None | U.S. Pine |
| Sugar Cane (bleachable) | 2.0/0.2 | 45 Min. | 85–100 | None | Bagasse |
| Bamboo (bleachable) | 3.0/0.2 | 45 Min | 85–100 | None | Bamboo |
| Wheat Straw (bleachable) | 1.0/0.2 | 45 Min. | 85–100 | None | Straw |
| Linerboard Pulp | 4.0/0.2 | 90 Min. | 85–100 | None | Spruce |
| Rice Straw | 0.5/0.2 | 45 Min. | 85–100 | None | Straw |

TABLE 1-continued

| | PULPING PROCESSES COMPARED | | | | |
|---|---|---|---|---|---|
| 6. Casey, "Pulp & Paper" Vol. 1, p. 406 Soda | 1.5 | 2.00 Hrs. | 150 | 100 | Rice Straw |

It is of course to be understood that the shortening of the pulping time in itself is not enough since pulp quality or the fiber strength characteristics must be maintained at normal levels for commercial purposes. The use of alum (aluminum sulphate) as an accelerant is employed in this vein and its being widely recognized and used in the paper industry as a safe, inexpensive, responsive chemical makes it application in the instant process easily acceptable by industry. However, other aluminum compounds can be used such as aluminum nitrate, aluminum chloride hydrate, aluminum oxide, etc., the use of which will be dictated by cost, ready availability and safety factors. The aluminum compounds are used in the ratio of nitrate ion equivalent to the relative concentration of active available aluminum ions.

The ability of the present process to be conducted at atmospheric pressure eliminates the explosive release of pressure that is normally used in conventional systems to empty the digester. This pressure release additionally defibers at least partially the natural fiber structure. The basic preservation of the fibrous structure permitted by the non-pressure system permits reduced chemical usage by easy drainage of cooking liquor and washing off of the residual cooking and black liquor leaving the fibrous structure still substantially intact. Defiberization can be closely controlled to preserve long thin fiber bundles from fibrous structures made up of very short (under 0.5 mm) fibers thus improving strength and maintaining good drainage characteristics even through the bleaching process where repeated washings present a major problem if drainage is poor.

All forms of ligno-cellulosic materials can be subjected to the pulping process of the present invention. That includes, without limitation, woody materials such as U.S. Southern pine, spruce, beech, and bamboo, as well as grassy materials which find usage such as straws, bagasse, and kenaf. In addition to these normally used sources of papermaking fibers, other, now wasted, fibrous plants, such as rape seed straw, and rice husks, which resist conventional pulping methods, can be reduced to commercially useful fiber by this process. High yield shrub growth, such as coppice willow, or agricultural waste, such as cotton stalks, presently unused, produces, including its bark, an acceptable, economically useful fibrous material with my process. Besides such virgin materials, the process of the present invention can be used to delignify and further defiber paper wastes, such as waste newsprint made from mechanical (groundwood) pulp or waste corrugated boxes containing semichemical board. Additionally, using the instant invention, it is practical to economically pulp accumulations of chipped wood slab waste and also sawdust, which is generally discarded.

The raw material should be in a uniformly sized particulate form before being submitted to the nitration step. Virgin plant material, for example, can be chopped, crushed, chipped, flaked or defibered, depending on the initial fibrous form to be processed. Paper wastes should be mechanically pulped in water to the defiber state, for example, to obtain a slurry containing about 5 to 9 weight percent preferably about 7 to 9 weight percent cellulose. Paper wastes are readily impregnated and reacted with the nitrating agent. In the process, mechanical and semi-mechanical pulps can be effectively upgraded through defibration of uncooked fiber bundles by delignification. My pulping process also permits the simultaneous removal of waste paper contaminants such as ink, plastics and wax, due to the temperatures used and the open vessel processing which permit separation of the contaminants. At the temperatures required for the pulping process and the low consistency during which reaction takes place these contaminants are released, rise to the surface, and can be aspirated easily from the vortex center of a second hydrapulper where they concentrate. Such contaminants which can represent 1-2% of the waste fiber furnish can be dumped along with the wire, rope and other extraneous contents found with waste paper.

Figure 1A:
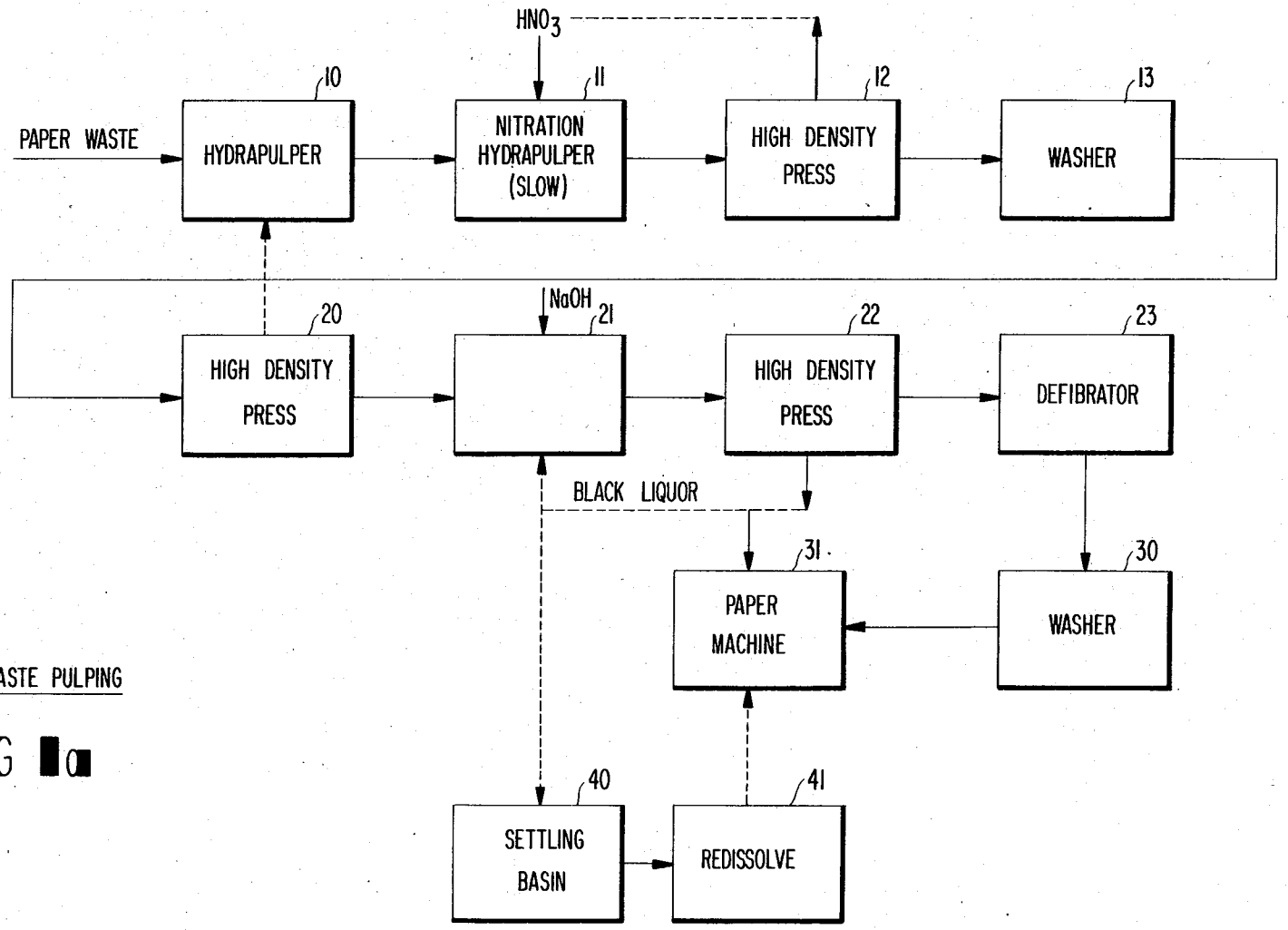
FIG. 1A is a diagram which illustrates a process for handling waste papers.

The process for handling waste papers is illustrated by FIG. 1*a* wherein the baled waste is pulped in a normal way in a hydrapulper and the wire, rope, wood, sheet, or film plastic removed by the conventional ragger.

The suspension of waste fiber is then pumped to a second hydrapulper where it is nitrated at 80°-90° C. with only moderate turbulence to permit the aspiration from the vortex of the wax, ink, styrofoam and plastic residues that will accumulate there.

The nitrated, cleaned material can then be passed through a high density press to remove excess alkali and lignin, then passed over a washer to remove excess alkali and lignin.

After defibering, conventional paper machine practice is followed.

The black liquor derived from the press 22 can be recycled to the extraction step 21 to fully utilize any unexpended alkali or partly diverted to the paper machine 31 where it can be precipitated on the fibers or to a settling basin where it can be precipitated and concentrated.

The nitration of the ligno-cellulosic raw material is accomplished by submerging or wetting with recycled nitrating agent the material in a sufficient amount of aqueous nitrating agent at elevated temperature, preferably about 75° or 85° to about 100° C., to accelerate penetration of the fibrous structure and react with the lignin. In order to permit the use of a non-pressure, open vessel for the nitration step with minimum emission of harmful nitrogen oxide vapors when using nitric acid as the nitrating agent, it is preferred to use as dilute a nitrating agent as possible with the limiting factors of time and pulp quality factors considered, say having a nitrating agent concentration ranging from 0.05 or 0.3 to about 7.0 to 7.5 weight percent, preferably less than about 4.5 or 5 weight percent. The exact percentage used will be dependent on the type of fibrous structure being pulped, the required level of delignification, time limitations and pulp quality desired.

The ligno-cellulosic raw material may be subjected to steaming and/or impregnation step before the cooking nitration step. The impregnation is done with a dilute concentration of the cooking liquor at low temperatures (e.g., about 70° C. or below, e.g., about 50° C. or below) and serves three purposes:

(a) utilization of drained concentrated liquor after the cooking process together with the dilute cooking liquor from the washing process,
(b) conservation of heat and chemicals by recycling liquor, and
(c) even moisture distribution throughout the fibrous structure before cooking.

In the process of the present invention where nitric acid is used as the nitrating agent it is augmented with a nitration accelerating amount of aluminum sulfate, preferably about 0.8 to 1.3 parts thereof per each 10 parts by weight of $HNO_3$. As stated above, the presence of the aluminum sulfate in the nitrating treatment serves to shorten the time necessary to convert the lignin component of the raw material to lignin nitrate, while holding quality levels of the resultant pulp at acceptable levels of strength. Normal usage is about 1 part of the aluminum sulfate ($Al_2(SO_4)_3 \times 18H_2O$) per each 10 parts by weight of $HNO_3$ (100%).

Alternatively other aluminum compounds can be used in the pulping process, e.g., aluminum salts of inorganic acids such as aluminum chloride, aluminum phosphates and aluminum nitrate, and aluminum oxides such as $Al_2O_3.\frac{1}{2}H_2O$. The aluminum compounds should be soluble in the aqueous nitric acid used in the pulping process.

The aluminum compounds should be used in amounts to achieve a sufficient aluminum ion concentration in the pulping liquor, often at least about 0.01 part, preferably about 0.065 to 0.105 part, by weight of aluminum ions per each 10 parts of $HNO_3$ (100%).

It has been found, however, that with exceeding a certain aluminum level no further advantage as to time reduction is obtained so that higher amounts are not desirable for both economic and environmental pollution reasons. The preferred range is approximately 0.065 to 0.105 part by weight of aluminum ions per each 10 parts by weight of $HNO_3$, a value of about 0.08 per 10 parts giving desirable results in the practice of the process of the instant invention.

The amount of nitrating agent used in the nitration step should be sufficient to completely submerge or contact by recirculation the particulate ligno-cellulosic material and adequate, on a stoichiometric basis, to nitrate substantially all of the readily accessible lignin content of the raw material. This will usually mean, for example, formation of a mixture of about 5 parts of liquid nitrating agent to about 1 part of dry wood to about 10 parts of liquid nitrating agent for 1 part of dry grass fiber (straw). Where the nitration liquor can be circulated and heated indirectly, lower ratios can be used. Additionally, the nitrating agent, either acid or nitrate salt, may be sprayed or it may be foamed in low concentration where minimum quantities but overall intimate contact may be needed.

The temperature at which the nitrating cooking step is performed should be adequate to effect nitration of the lignin, but is preferably not so high (over 100° C.) as to cause degradation of the cellulosic fibers or so low—below 75°—to take excessive reaction time. Temperatures in the range of about 75° or 85° to 100° C., in particular about 85° to 95° or 100° C., are preferred.

The nitration-extraction process of the present invention can be performed in a short period of time, under atmospheric pressure conditions, although above atmospheric pressures, e.g., up to about 10, 15 or 35 p.s.i.g., can be used if it is desired to shorten further the time, but can be used chiefly to provide ease of production on a continuous basis. The pressure may be up to about 150 p.s.i.g. and such may be particularly advisable in certain situations as noted below. The improvement provided by the present invention is independent of whether the process is conducted under atmospheric pressure or at elevated pressures. The introduction of a non-pressure system is designed specifically for use in new and relatively small pulping installations (10–50 tons per day) throughout the world. However, it is recognized that the requirement for larger production units can be met by larger or multiple units and that in many instances existing pulp mill equipment could be utilized to reduce further investment costs while minimizing present pollution problems.

All present commercial systems employ high pressures and temperatures coupled with long cooking periods for pulping woody fibers to chemical grade pulps. It has been found that by cooking with light pressures (e.g., up to about 15 to 35 p.s.i.g.) while holding temperatures certainly below 110° C. and preferably below about 100° C., the nitration period can be shortened to about 5 to 7 or 10 minutes for wood flakes, straw, etc. Conventional sized wood chips, 6–20, but generally 10–20 mm., thick are usually too irregular in size for cooking by the instant process and must be made uniform and generally smaller in size to achieve uniformly cooked and defiberable pulp of normal quality levels in one hour's time.

Using light pressures with either wood flakes or chips makes practical the conversion of existing sulphite pulp mills to the process of this invention. However, the use of pressure for pulping any fibrous structure or wood flakes or chips is not necessary and is recommended only to fill the utilization possibilities of existing installations.

Pulping systems, such as the "Kamyr" or "Pandia", which are continuous, operate at high pressure, about 150 to 175 p.s.i.g. These units are also adaptable for processing wood chips in one stage in accordance with the present invention to produce a semi-chemical type product or full chemical pulping.

Typical times and conditions at these different pressures for treating several ligno-cellulosic materials and where an alkali delignification state is being used, are in Table 2a.

TABLE 2a

COMPARATIVE $HNO_3$ PRESSURIZED NITRATION CYCLES CHEMICAL OR DELIGNIFIED PULP WITH ALKALI STAGE

A. Non-Pressure System - Wood Flakes or Equivalent

| | | Pine | Spruce | Beech | Straw |
|---|---|---|---|---|---|
| Cooking Time | Minutes | 15 | 15 | 15 | 15 |
| Temperature | °C. | 85–100 | 85–100 | 85–100 | 85–100 |
| Liquor Concentration | % Acid | 5.5 | 5.0 | 4.0 | 1.0 |

B. Pressure 15–35 P.S.I.G. - Wood Flakes or Equivalent

| | | Pine | Beech | Straw | Bamboo |
|---|---|---|---|---|---|
| Cooking Time | Minutes | 7 | 7 | 5 | 7 |

TABLE 2a-continued

| COMPARATIVE $HNO_3$ PRESSURIZED NITRATION CYCLES CHEMICAL OR DELIGNIFIED PULP WITH ALKALI STAGE | | | | | |
|---|---|---|---|---|---|
| Temperature | °C. | 100–110 | 100–110 | 100–110 | 100–110 |
| Liquor Concentration | % Acid | 5.5 | 3.5 | 0.5 | 2.5 |
| C. Non-Pressure System - Wood Chips | | | | | |
| | | Spruce | Beech | | |
| Cooking Time | Minutes | 60 | 40 | | |
| Temperature | °C. | 95–100 | 95–100 | | |
| Liquor Concentration | % Acid | 4.0 | 3.5 | | |
| D. Pressure 15–120 P.S.I.G. - Wood Chips | | | | | |
| | | Spruce | Beech | Beech Semi-Chemical | |
| Cooking Time | Minutes | 45 | 30 | 15 | |
| Temperature | °C. | 100–110 | 100–110 | 110 | |
| Liquor Concentration | % Acid | 4.0 | 3.5 | 3.0 | |

Additionally, it has been found that the use of pressure permits full defibering of wood fibrous structures in the acid nitration stage, and a lignin alkali extraction stage may thus be avoided since the lignin component is hydrolyzed by this stage. This can be accomplished when nitric acid is the nitrating agent by raising, dependent on fibrous structure processed, the $HNO_3$ liquor concentration by about 2.5 to 3.5% over that employed for the normal nitration-alkali delignification sequence, and extending the time of reaction slightly, e.g., by about 3–5 or more minutes.

Thus, without using pressure, i.e., when conducting the process under approximately atmospheric pressure conditions, the $HNO_3$ liquor concentration may be up to about 5.5 weight percent, preferably up to about 5 weight percent. When employing elevated pressures, the $HNO_3$ concentration may be no more than about 7 to 7.5 weight percent, and the lower concentrations as stated for the non-pressurized nitration step can be advantageously used.

For grassy fibrous structures pressure is not necessary and only a 0.5–1% additional acid concentration is required.

This embodiment of the present invention without an alkali stage produces a fiber with different strength characteristics from that obtained when delignification is accomplished by alkali extraction. The fiber is, however, of very light colour, high yield and can be easily bleached.

Regardless of the pressure employed, it is not necessary to vent any gases, in fact it is preferable, since with the gases contained and retained in the treating vessel, a false pressure is created, permitting the keeping of operating temperatures below 110° C. thus avoiding cellulose degradation. The degree of false pressure created is dependant on nitrating agent concentration.

Typical times and conditions at different elevated pressures for treating several ligno-cellulosic materials without there being an alkali delignification state, are in Table 2b. Where additional pressure is needed, as in the "Kamyr" pulping process, it can easily and economically be obtained with air injections. The low temperatures involved reduce the chronic problems of scaling and maintenance to a minimum.

TABLE 2b

| Comparative $HNO_3$ Pressurized Nitration Cycles, Alkali Delignifaction Stage Eliminated | | | | | |
|---|---|---|---|---|---|
| A. Pressure 15–35 p.s.i.g. - Wood Flakes or Equivalent | | | | | |
| | | Chemical Pulp | | | |
| | | Pine | Beech | Straw | Bamboo |
| Cooking Time | Minutes | 10 | 10 | 6 | 10 |
| Temperature | °C. | 100–110 | 110 | 110 | 110 |
| Liquor Concentration | % | 9.0 | 5.5 | 1.5 | 5.0 |
| B. Pressure 100–150 p.s.i.g. - Wood Chips | | | | | |
| | | Chemical Pulp | | | |
| | | Spruce | Beech | | |
| Cooking Time | Minutes | 45 | 45 | | |
| Temperature | °C. | 100–110 | 110 | | |
| Liquor Concentration | % | 8.0 | 5.5 | | |
| C. Pressure 35–150 p.s.g.i. - Wood Chips | | | | | |
| | | Semi-Chemical Pulp Mixed Hardwoods | | | |
| | | Beech | | | |
| Cooking Time | Minutes | 10 | | | |
| Temperature | °C. | 100 | | | |
| Liquor Concentration | % | 4.0 | | | |

The ability to conduct the nitration step at atmospheric pressure means that non-pressure vessels can be employed, providing a substantial savings in equipment and operating cost compared to conventional high-pressure pulping processes. Although a non-pressure vessel is employed for the nitration step, it is preferred to maintain closure with recycling of any vapors to prevent heat loss and possible emissions. Present environmental laws in the U.S.A. permit a maximum nitrogen oxide emission level of only 185 ppm. The precise temperature at which nitrogen oxide or other gases can be released from the slurry in the nitration step will depend upon the concentration and form of the nitrating agent, since the higher the concentration, the lower will be the temperature at which vapor emissions will occur.

By way of further explanation, nitric acid decomposes at about 86° C. into water and nitrogen oxide gas, which is potentially lethal and can be explosive when in highly concentrated form. Where an impregnation step becomes preferable to economize on nitric acid consumption through recycling of partly spent or diluted acid it is desirable to maintain low temperatures, e.g., 50° C. or below. Temperatures over 85° C. will produce nitrogen oxide gas which, depending on the acid concentration, will be more than the water can hold in solution and will be have to be contained and recycled.

When a closed, non-pressure vessel is being used to conduct the nitration step in the process of the present invention, it will usually be preferred to employ a temperature no higher than about 90° to 95° C., e.g., within the range of about 85° to 95° C. However, as stated hereinbefore, when operating the nitration step under pressure, a temperature of up to 110° C., preferably up to 100° C., may be employed. It is an outstanding advantage of the process of the present invention that it can be performed in non-pressure vessels in economically short time periods, without causing difficult air pollution problems. Additionally, the elimination of the usual chemical recovery system eliminates emission of dust particulates which are a major source of air pollution.

The nitration step, and indeed the entire process of the present invention, can be carried out continuously, semi-continuously, or batchwise, whichever is desired. Selection of equipment will of course depend upon that choice. It is generally more economical to conduct the process continuously, in which event the nitration step can advantageously be conducted in a screw conveyor unit. Batchwise nitrations can be carried out quite well in a modified hydrapulper, making possible the economic operation of very small mills (10 tons per day).

The nitrating agent impregnation and cooking steps are conducted for a time sufficient to produce the required residual level of the ligneous component of the ligno-cellulosic raw material after extraction of the lignin.

The time required to effect the desired degree of nitration is dependent, of course, on the strength of nitrating agent used, as well as the temperature employed, since higher strengths and temperatures promote the nitration reaction. Additional considerations are the type and particle size of the ligno-cellulosic material being processed. In general, with the process of the present invention the total nitration time can be as short as about 5 minutes or as long as about 30 minutes or to about 90 minutes if wood chips are used. For straw or bagasse, which will go into storage before delignification, a simple spray or foam application at lower levels of nitrating agent concentration, at room temperatures is all that is necessary to obtain the desired level of nitration.

Following the nitration step the ligno-cellulosic material is separated from the nitrating agent solution and washed with water to remove surface chemical. The wash water is preferably hot, e.g., at a temperature of about 35° to 100° C., and is used in minimal amounts. One efficient method, if a continuous system is used, is by reverse flow washing or with reverse flow washing on a vacuum filter. Alternatively, draining, followed by flooding with wash water and a second draining can be used.

When the cellulosic raw material is from waste paper products, the removal of the excess chemical is accomplished with a high density press.

The separated nitrating agent is advantageously returned to the nitration step to be used over again, as is any wash water. The recycled nitrating agent stream will be fortified with concentrated chemical and with a fresh source of aluminum ions so as to restore the concentrations of those reagents to the desired levels.

The nitrated fibrous structures remain intact and appear to be essentially the same as when those particles were introduced to the nitrating agent submersion step, except for a slight softening and darker colour. The nitrated fibrous structures can be held in storage for months without either deteriorating or causing problems in the lignin extraction and defibering steps which follow. This storability feature can be of special advantage in the case where straw, bagasse or similar grassy plants are to be pulped since grassy plants are usually harvested during relatively short seasons. This presents a problem because grassy plants are particularly susceptible to deterioration during storage. By the process of the present invention the excess raw material can be nitrated by spraying or foaming a dilute solution of acid to obtain intimate, overall contact with the fiber and held in storage in that form without being degraded. Extended periods of storage have been experienced up to one year in contact with the acid at a moisture level of about 25 or 30 to 50% permitting usage of a lower percentage of acid to dry fiber, e.g., about 1–3% where about 30% moisture level is used.

The nitrated ligno-cellulosic material can next be submerged in an alkaline, aqueous extraction solution, e.g., a solution of sodium, calcium, potassium and/or ammonium hydroxide or mixtures of same so as to dissolve most of the nitrated lignin out of the fibrous structure. The lignin nitrate is substantially insoluble in acidic aqueous media, but is readily dissolved in basic aqueous media, for example having a pH of about 7.5 to 12. The alkaline concentration of the extraction solution must be sufficient that the solution will leach out, or dissolve, most of the nitrated ligneous material in the fibrous structure. Usually it is preferred to use an alkaline strength (alkali metal bases such as NaOH or KOH or $NH_4OH$) of about 0.1 to about 0.5 or 1.5 weight percent, preferably about 0.1 to 0.3 weight percent. If the nitration-extraction sequence is performed twice on the ligno-cellulosic material, then the alkaline strength used in the second extraction step need not be as high as that employed for the first extraction. Often the concentration of the alkaline solution used in the second nitration-extraction sequence will be about one-fifth to one-half that which is used in the initial sequence. Frequently, it will be preferred that the second extraction step employ an alkaline strength (NaOH, KOH, or $NH_4OH$) of about 0.05 or 0.1 to 0.8 wt. %, preferably about 0.05 to 0.15 wt. %. The alkaline consumption is basically one of bringing the starting pH to about 12 and can therefore be dependent upon the concentration of residual nitrating agent remaining if it is acidic.

The amount of the alkaline extraction solution used should be adequate to completely submerge or continuously contact the ligno-cellulosic material and dissolve out most of the nitrated ligneous components. Usually the amount of alkaline extraction solution used will provide a slurry containing about 5 to 35, say about 5 to 20, and preferably about 5–10 wt. % of cellulosic fiber, or may be in a weight ratio of 6 or 10 to one part cellulose fibrous material, dependent on process used and fiber structure being processed.

The temperature at which the alkaline extraction step is conducted should be sufficiently high to effect dissolution of most of the nitrated ligneous material. Preferably a temperature of about 75° or 85° to 100° C. is used, normally 95° to 100° C. Temperatures as low as about 65° C. can be used for grasses which will extend the time necessary for delignification. These low temperatures are particularly important in producing animal feed or partially defibered pulp from agricultural residues. Where straw as an example for an agricultural residue has been sprayed with nitric acid as a nitrating agent and held in storage, delignification with alkali at about 50° C. will produce with mechanical defibering a fully defibered pulp suitable for the manufacture of corrugating medium.

The alkaline extraction step is also performed under atmospheric pressure conditions, thereby permitting the use of non-pressure vessels and avoidance of expensive high pressure equipment. Closure of the vessel is desired only to conserve heat. There are no fumes or chemical gases given off unless $NH_4OH$ is used. Pressure equipment could be used but increased temperatures using dilute alkaline solutions will normally result in degradation of the cellulose and loss of fiber strength.

It will be recognized that the time required to effect the desired degree of extraction is dependent on the strength of the alkaline extraction solution used, the particle size and type of the ligno-cellulosic material and the temperature at which the extraction is conducted. In general, however, the total time required for the lignin extraction will be no more than about 30 minutes, being within the range of about 5 to 15 minutes for agricultural residues and wood flakes and 30 minutes for wood chips.

For the extraction step, it can advantageously be in a hydrapulper or a screw conveyor may be preferred for continuous operations.

After treatment with the alkaline extraction solution, the fibrous cellulosic material is separated from the lignin containing solution by drainage for wood chips or preferably by a high density press for straw or similar fibrous structures. The mild, short cooking conditions are such that the individual fiber structure and small fiber chains can, by controlled mechanical defiberization be maintained as whole and complete fibers—for example straw fibers measuring about 1.2 mm in length and only about 0.006 mm in width—are preserved intact. Conventional paper making fibers (pine) measure about 0.05 mm in width. The principal benefit of preserving fiber strength either individual fibers or chains of small fibers, is that it enables one to manufacture higher strength paper out of the final pulp and improves drainage characteristics.

When the desired degree of cellulose purity is obtained, the cooked delignified fibrous structure is mechanically defibered and then conveyed to screens where any remaining outsize fiber bundles are screened out and returned to the cooking steps for further lignin extraction and defiberization. From this point on, the separated cellulosic pulp is subjected to normal paper mill operations of cleaning and formation of the fiber web on the paper machine to make board or paper.

After the extraction step the alkaline solution contains dissolved ligneous components and is dark reddish brown in colour and is commonly referred to as "black liquor".

As the alkaline black liquor is recycled to the lignin extraction process, the content of dissolved solids in the black liquor will grow to a maximum tolerable concentration, e.g., somewhere in the range of about 10 to 25 wt. %, generally less than 20 wt. %. An appropriate portion of the black liquor should be purged regularly (5–10%) and replaced with make-up alkali in order to prevent excess increase in the concentration of the dissolved solids and to maintain required pH level. The black liquor purge stream can be disposed of by various means such as by dumping as waste, or by concentrating and burning as in the conventional sulphate recovery system. Alternatively, the black liquor purge stream can be combined with the completely defibered pulp to supply ligneous binder for fiber web products prepared from the pulp, especially paperboard, as described in application Ser. No. 699,188, filed June 23, 1976, application Ser. No. 855,754, filed Nov. 29, 1977, continuation application Ser. No. 20,978, filed Mar. 16, 1979, and application Ser. No. 74,658 filed Sept. 12, 1979 of which this application is a continuation-in-part, to develop or extend paper sizing materials or to act as binding material in the manufacture of building or heavy packaging board.

According to an embodiment of the invention described in my prior application Ser. No. 699,188, after the process has been running long enough to provide a concentrated lignin-containing extraction liquor, that liquid may be divided into two parts. One part, e.g., comprising about 5 to 80%, preferably at least about 50%, of the total, is fortified with additional alkali (sodium hydroxide or potasium hydroxide) and is recycled to the lignin extraction step for use in treating further amounts of nitrated ligno-cellulosic use in treating further amounts of nitrated ligno-cellulosic material. The other part of the lignin-containing extraction liquor is added back to the pulp. In a continuous system, this is most easily accomplished by continuously recycling and fortifying the black liquor in the alkaline extraction step and continuously bleeding off a portion, say about 20 to 30% or less, say about 10%, of this liquor for later introduction into the pulp slurry or for precipitation. In the manufacturing of paperboard and the like, where coloration is not critically important, it has been found advantageous to add the lignin-containing extraction liquor up to 15% black liquor solids to the cellulosic pulp which results in a darker but acceptable paperboard product, due to the precipitation of the lignin on the fiber. In the course of forming the paperboard product on the paper machine from the cellulosic pulp, aluminum sulphate (papermaker's alum) is normally added to the pulp in an amount sufficient to lower the pH of the pulp within the range of about 5.0 or 5.5 to 6.5. When the dissolved ligneous material has been added back to the pulp in accordance with the present invention, such subsequent lowering of the pulp's pH causes an amorphous precipitate of the lignin to form, which deposits itself on the cellulosic fibers. A major portion of the very fine fibers suspended in the pulp adhere to and are retained by the precipitate as well. This is beneficial because in the conventional paper making processes cellulose debris and short fibers, which often amount to about 0.3 to 2.5 wt. % of the total fibers, are not retained on the fiber web, but instead are lost with the drain and wash water, exacerbating the pollution problems or build up concentration in the overall papermaking process, requiring addition of retention agents to assist retention in the fiber web.

A further benefit of adding the extracted ligneous material back to the cellulosic pulp according to the process of the present invention is that the paperboard or other fiber web produced from the lignin-containing pulp will be in most physical properties stronger than if the lignin were not present, this being particularly so when waste paper fibers are incorporated into the ultimate paper product.

The extracted ligneous component may be added back to the cellulosic pulp in aqueous solution form. This can be done by simply adding the untreated black liquor directly back to the pulp. Alternatively, the ligneous material can be removed from solution in the black liquor and then mixed with the pulp. To remove the ligneous material from solution in the black liquor an acid, preferably nitric or phosphoric, most preferably nitric, can be added to the black liquor at a temperature of about 15° to 90° C. to cause the ligneous material to precipitate as an amorphous flocculant. Separation of the precipitate from the mother liquor can be efficiently accomplished by centrifugation or by decantation in a settling basin. The amount of acid used is preferably a quantity sufficient to lower the pH of the black liquor to about 7 with alum used thereafter to bring it to lower levels of 6 or below. The mother liquor is clear but slightly colored and contains some dissolved solids, usually less than 0.5 wt. % thereof. The mother liquor can be recycled to the nitrating agent impregnation step or alternatively where the nitrating agent is nitric acid it may be used again as a source of acid in the precipitation of the ligneous material from the black liquor. The precipitated concentrated ligneous component can be resolubilized with alkali but this is not necessary for addition to fiber slurry or paper web.

When the alkali lignin extraction process is complete, the pH of the black liquor will be about 7.5 to 9.5 preferably about 7.5 to 8.5, which is lower than that of conventional alkaline processes which are usually in the range of 12 to 14. It is recognized that the neutral sulphite process for semichemical (NSSC) produces a neutral pH 7 black liquor. However, this liquor has no value either for the purpose of chemical recovery or for its lignin constituents and is therefore one of the major polluting processes in use unless tied into the kraft mill operation for chemical recovery. Sulphite acid systems produce black liquor in a pH range of 1.0 to 2.0. The factor of an essentially neutral pH makes the black liquor obtained with the present invention substantially more amenable to handling and use in subsequent chemical processing. Additionally, the black liquor of the present invention has a low range of $BOD_5$ (Biological Oxygen Demand—5 day) and COD (Chemical Oxygen Demand), permitting its discharge, if it became necessary, in controlled amounts, e.g., up to 30%, in the normal urban effluent stream. Typical comparative pollution data are as follows:

| Values in mg/liter | Present Invention Accelerated Pulping Black Liquor | Waste Paper Mill Effluent | Sulphite Mill Black Liquor |
|---|---|---|---|
| 5 day biological oxygen demand | 1500 | 8010 | High |
| Chemical oxygen demand | 5685 | 16700 | 230,000 |
| Permanganate number | 11215 | — | 400,000 |

The $BOD_5$ value when related to recently recorded (North America) $BOD_5$ discharges per ton of pulp produced shows the following values: sulphite mill 109 kg.; integrated sulphate pulp and paper mills, 15 kg.; waste paper mill, 10 kg., and the accelerated pulping process, 30 kg. The low figure of the sulphate mill is reached only by burning all the black liquor solids produced to recover the major portion of the chemicals used in the process and by additional strict control of the remaining pollutants.

An alternative use for all or part of the solid ligneous material removed from solution in the black liquor is to fertilize plants. By using potassium hydroxide or ammonium hydroxide as the alkaline extraction agent, followed by phosphoric acid to completely neutralize the black liquor, a material is obtained which can be used as a balanced fertilizer for plants containing nitrogen values from the nitric acid and ammonium hydroxide or alternatively potassium from the use of potassium hydroxide, phosphorus values from the phosphoric acid precipitation step, and humus-supplying values from the ligneous components. In dry form the ligneous solid is brown in colour, not malodorous (having a mild vanillin scent), almost tasteless and hygroscopic. Normally, expected usage would be in the form of liquid fertilizer.

The ligneous solid can be obtained from the black liquor produced in the process of this invention can be especially useful as a plant fertilizer because it is low in toxic phenolic compounds, generally containing no more of those compounds than are present in the original plant fiber structure. When tested for toxicity and as fertilizer on barley and oat seeds in inert clay, the ligneous solid of this invention performed well, as evidenced by the fact that 95% of the seeds germinated and 95% of the plants exhibited normal growth.

In summary, the black liquor obtained in the process of the present invention may be utilized with only minor modification uniquely and economically in a variety of ways as a binder, water repellant or size, extender for fortified rosin size, stiffening agent in paperboard, hygroscopic fertilizing additive to solid, extender for resins such as phenolics and retention agent in papermaking.

The solids, i.e., non-volatiles, in the black liquor are referred to as the ligneous component. Although there are present chemicals other than lignin and lignin nitrate, such as gums, waxes, etc., in the ligneous component, the lignin and lignin-nitrate comprising the major component. The useful ligneous component can be precipitated from its mother black liquor by acidifying, preferably to a pH of about 4.5 to 5.5, with any mineral acid or acid salt, but of particular usefulness are ordinary papermaker's alum (aluminum sulphate), recycled nitrating agent from the process and phosphoric acid.

For normal papermaking the black liquor or the black liquor precipitate resulting from acidification, e.g., with nitric acid and/or alum, can be added to the cellulosic pulp. The black liquor in its neutral pH form or acidified can be foamed and added to the pulp at the size press or wet presses. Unlike kraft liquor the black liquor under any normal treatment either in solution or precipitated exhibits a minimum and non-troublesome amount of foaming. The foaming of the black liquor, either itself or in concentrated form (precipitated ligneous component) and before or after mixing with the pulp, can be done by adding to water a commercial surfactant, hydrophylic or hydrophobic foaming chemical, and then foaming the mixture with air and then adding as required the black liquor and other additives such as starch etc. Foaming of various dilute solutions or suspensions is generally known, however, not with the high percent solids formed by the ligneous component produced in the present invention. Addition of the precipitated black liquor solids to the pulp slurry from which the black liquor is separated, lowers the stock freeness, i.e., drainage rate, since it holds or retains the fine, suspended particles usually lost without the use of retention agents through drainage on the paper machine wire. Addition of the black liquor to paper fibers in minor but sufficient amounts, about 0.1 or 2 up to about 15%, and generally in an amount of about 0.1 or 1 to 10%, most preferably about 2% to 5%, based on the solids and calculated on the dry weight of the fiber, will increase most paper strength properties, in an approximate ratio of improvement of 2:1 for equal weight of cellulose fiber. Depending on the degree of openness of the fiber web making up the paper and on new pH levels ranging from 5.0–6.5, improvements in burst and stiffness show improvement ratios of 25:1 compared to an equivalent fiber weight. when black liquor solids are combined with an aqueous starch solution and added at high temperatures (e.g. about 65° C. or above) at the size press, a satisfactory sizing of paperboard (Cobb 30–50) will be obtained and the effectiveness of the starch in improving paper quality is greatly improved permitting reduced starch usage. A small percentage, say about 0.4 or 0.6 to about 1 percent of black liquor solids, based on the dry fiber content is generally sufficient for this purpose in addition to showing improvements in burst.

The neutralized form of the black liquor can be added in substantial amounts, e.g., up to about 40 to 60 percent solids, to an aqueous solution of fortified rosin size having, for instance, about 20–30% neutralized urea and 20–30% fortified rosin size, and obtain sizing properties equal to that of the rosin size when used alone. This combination can be precipitated on fiber suspensions in the conventional manner with alum.

The neutralized form of the black liquor precipitate is hygroscopic when dried and can be used when combined with fast draining materials such as soils, e.g., sandy soils, to retain moisture and chemicals. When the fiber cooking process (alkaline extraction) and subsequent precipitation are conducted by using as part or all of the treating agents the three chemicals essential to plant life, i.e., nitrogen (nitric acid), potassium (potassium hydroxide), phosphorous (phosphoric acid), the black liquor slurry becomes a complete fertilizer in itself in addition to its moisture retention properties. This can be readily achieved by using potassium hydroxide in the alkaline extraction step and by neutralzing the liquor and precipitating the ligneous component out of the extraction liquor by using phosphoric acid. Tests show normal germination and growth rates for barley and oats, when this liquor slurry is added to an inert clay. For easy handling the slurry can be combined with diatomaceous earth to inhibit hygroscopic properties and a deliquescence inhibiting amount of the diatomaceous earth may be used.

The acidified or neutral form of the black liquor can also add its binding properties to such resins as melamines or phenolics, permitting extension of these relatively expensive products. The black liquor can be used in the preparation of resins since its nitrated form is compatible chemically with that of many other resins.

The acidified black liquor precipitate may be resolubilized by changing the pH to about 7.5 by alkali addition and then again precipitating with acid at pH of about 4.5 to 5.5, making possible the concentration of the ligneous components through precipitation and then resolubilizing for further use in a more neutral form.

During the alkaline extraction step most of the lignin nitrate dissolves in the alkaline solution, leaving the fibrous structure softened and perhaps partially defiberized. At this point the concentrated black liquor should be drained off for recycling or purging from the system as required. Since little mechanical and/or explosive force has been exerted the point of fiber liberation will not have been reach as under normal pulping conditions. Some of the ligneous component remains partially in and around the fibers, somewhat holding them together, but complete defibering can be readily accomplished by appropriate mechanical means, for example by subjecting the softened structure to the action of a double disc defibrator or a deflaking unit, machines which will physically break apart the soft fiber bundles without causing substantial injury to the fibers themselves.

It is preferable after mechanical defibering except for animal feed and semi-chemical type pulps to wash the fibers with water to remove surface alkali and black liquor. Washing is preferably accomplished with a minimal amount of hot water, e.g., at a temperature of about 85° to 100° C. The washing can be performed in any suitable manner, but a preferred way is by use of a rotary washer.

Following mechanical defibering and washing, the cellulosic pulp can be subjected to a second nitration-extration sequence, as discussed above, or it can be used in any of the conventional ways to make cellulosic fiber webs. For pulps other than those intended for semi-chemical board or animal feed it will usually be preferable to first screen the pulp, however, so as to remove any large fiber bundles that withstood the pulping process, which bundles can then be returned to the nitration step. Most commonly, the screened pulp will be supplied to the headbox of a paper machine, alone or in admixture with other types of fibers, and there used to make paper products.

Considering a comparison of the pulping process of the present invention with previous processes, several advantages are apparent. Chief among them is the ability to have a closed water and chemical cycle in a system which is economically feasible. As mild nitrating agent conditions are used and a pressurized system is not required, capital investment for my process is reduced by at least 25% when compared to present day mills.

Pulping installations (producing from 10 to 50 tons or 100 tons of pulp a day) become possible when the conventional chemical recovery system (which operates marginally only on a minimum production of 250 tons per day of pulp production) is eliminated. The time required for chemical treatment of the process of the present invention is less than one half the time of the most rapid present day chemical process for chemical pulp.

My process develops no preceptible odor. Contrastingly, those developed by the kraft pulp mills can still be objectionable many miles away. For this reason my pulping process can be located without objection near any community that has a requisite fiber source.

Historically, black liquor has had to be disposed of by evaporation and subsequent burning, or by discharge into lakes, rivers or the sea. These disposal methods contribute, of course, to air and water pollution. To some extent, some black liquor is used in the manufacture of tall oil, vanilla, drilling muds, and bonding extenders, but for the most part these operations are marginally economical. This invention contemplates the upgraded and profitable usage of 100% of the black liquor, providing a waste-free system.

It is a feature of this invention that in the case of fibrous structures, such as straw, both nitration and delignification can be accomplished in one step using a solution of nitrate salts such as $NaNO_3$, $NH_4NO_3$ or $KNO_3$ with alkalization of the mixture to a basic pH of about 11 to 13, e.g., about 12, with NaOH, KOH, $NH_4OH$, in combination of desired, or other suitable alkalies. Generally in this one step operation temperatures in the range of 85° to 100° C., preferably 90° or 95° to 100° C., are used. In the one step operation using nitrate salts as the nitrating agent for pulping grassy materials, about a 0.01%–0.05% solution of nitrate salt, e.g., $NaNO_3$, is carried out at a temperature of about 95°–100° C. for approximately 30 to 60 minutes, alkalized by using NaOH, KOH, or $NH_4OH$ to a pH of about 11 to 12.

The ease of nitration in this case is dictated by the thin structure of these fibrous materials and their low percentage of extraneous materials, such as waxes and resins and other hydrophilic materials. Wood chips can, however, be easily pulped by the one step operation producing a fiber that shows that nitration has proceeded only to the middle lamella, leaving the lignin in the fiber wall itself virtually untouched. Total time for processing remains essentially the same as that of the sequential process.

The process of delignification serves to dissociate the fibers making up the natural fiber structure freeing the lignin and providing fibers which can be formed into a web for production of paper or board. On a modified or reduced scale of delignification in a relatively dry state (30 to 50% moisture) the lignin can be released in situ to act as a binder for the production of building board in which the fibrous structure remains essentially intact. Delignification will also increase the digestibility of fibrous structures for herbivores, cows and sheep etc. Animal feed is being produced today from straw by addition of ca. 5% NaOH to the dry weight of straw in a process which makes cubes or pellets with additional food additives. Additionally, work has been done with $NH_4OH$, liquid or gaseous $NH_3$, but this has not proven practical. Utilization of feed produced with NaOH is limited because the improvement in digestibility (food value) is low and the alkali content is high. An improvement to some 300% would be required to meet the food value of corn sileage. Levels of improvement presently obtained processing straw are one tenth of this, and maximum utilization in the animal's diet has not exceeded 15%.

This invention provides a controlled method of delignification which increases digestibility by up to about 100 or 150% to the point that the processed straw can comprise a minimum of 50% of the animal's total diet. Mixed during compounding with other food supplements, as molasses, urea, protein, etc., a complete food can be formulated. Of equal importance is the potential of this process to be economic in small installations which further makes possible a joint production facility producing alternatively, as required, animal feed and paper making fiber, providing flexibility to meet market demands local and long distance.

It is characteristic of agricultural residues that they are bulky making it impossible to meet minimum weight requirements of shipping carriers resulting in high freight costs. Processing under this invention makes viable the production of compact finished or semi-finished product of high density which greatly reduces freight and handling cost.

The alternatives provided by this invention in accomplishing nitration and subsequent delignification of agricultural residues extend to choices of acidic (nitric acid) or a variety of nitrate salts in nitration, various levels of chemical concentration varying time and temperature for both nitration and delignification steps and a choice of alkaline chemicals (KOH, NaOH, $NH_4OH$) to accomplish the pH level necessary for solution of the nitrated lignin.

For example the process may be implemented using shredded grassy residue materials such as wheat straw, bagasse or shredded woody stems such as can be derived from 2–3 year old coppice willow or cotton stalks.

As a specific example: Baled wheat straw is shredded, a nitrating agent comprising nitric acid plus aluminum sulphate in a ratio of 10 parts $HNO_3$ (100%) to 1 part aluminum sulphate (100%) is sprayed evenly on the defibered straw; 1%–4% nitrating agent to the dry weight of the straw.

The nitrated straw is heat treated in for example a rotary dryer at a temperature of approximately 120° C., for approximately 20 minutes. During this interval the straw is completely diffused with the chemical. The lignin component reacts with the nitrating agent to form lignin nitrates and/or oxidized products soluble in alkaline pH (7.0+) solutions.

The pH levels of the straw leaving the heat treatment will characteristically be approximately about 6.0 pH when 1% nitrating agent is used, to a pH of about 3 to 4 or 5 when 4.0% nitrating agent is used.

The nitrated straw can be immediately treated with hot alkali solution comprising an aqueous solution of about 1.5 to 2% NaOH, KOH or $NH_4OH$ in an amount sufficient to comprise about 2–5% by weight of the straw and heat treated at about 95°–100° C. for about 10–15 minutes to obtain fiber release or softening of the fiber structure. Control of pH from 8.0 to 13.0 during this stage will result in increasing amounts of lignin being solubilized as the pH level increased.

Alternatively and more economically, the nitrated straw can be washed by submerging or spraying with water to remove excess acid and then passed to the alkalizing step for release of the lignin. The acidic wash water can then be used for bringing the pulp to a neutral pH level. The nitrating agent and alkali can also be added simultaneously to the straw before entering the dryer in such a ratio of use that a pH of 11–12 is maintained.

NaOH would commonly be used as the alkali in the manufacture of pulp for paper or board. For animal feed solutions of $NH_4OH$ or urea $CO(NH_2)_2$ are preferable since the sodium ion is eliminated or reduced but can be used in combination with NaOH to more easily control the pH level.

For cubed straw by extrusion the dry form of the nitrated straw is intimately mixed with the alkalizing solution raising the moisture content to not more than 15% to effect the formation of a firm condensed cube. In this form the straw can be economically transported and processed further in a hot solution for the production of paper or paper board or animal feed.

Figure 18:
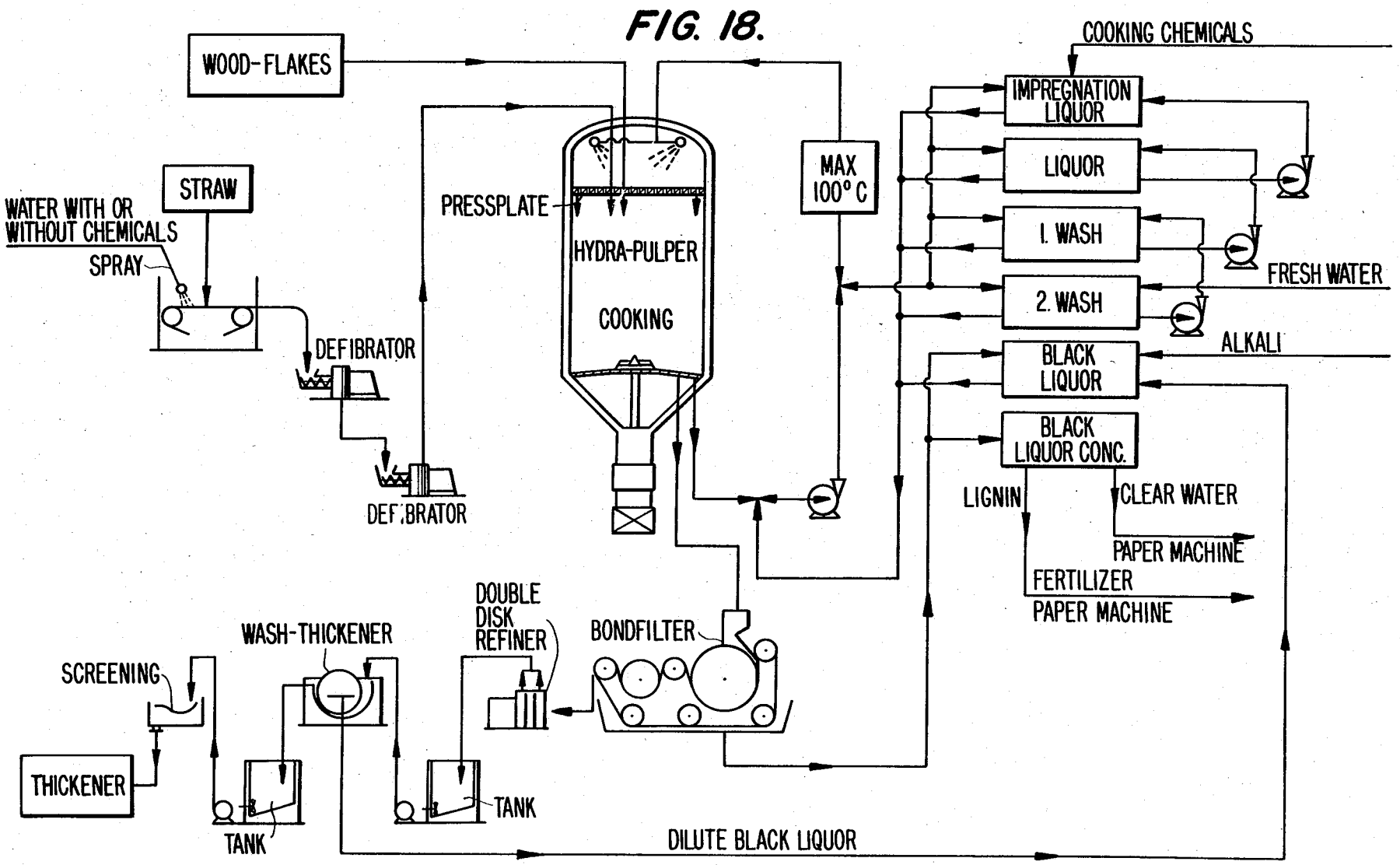
FIGS. 18 and 19 are diagrams illustrating two possible mechanical installations for pulping that may be used in accordance with the process of the present invention.
Figure 19:
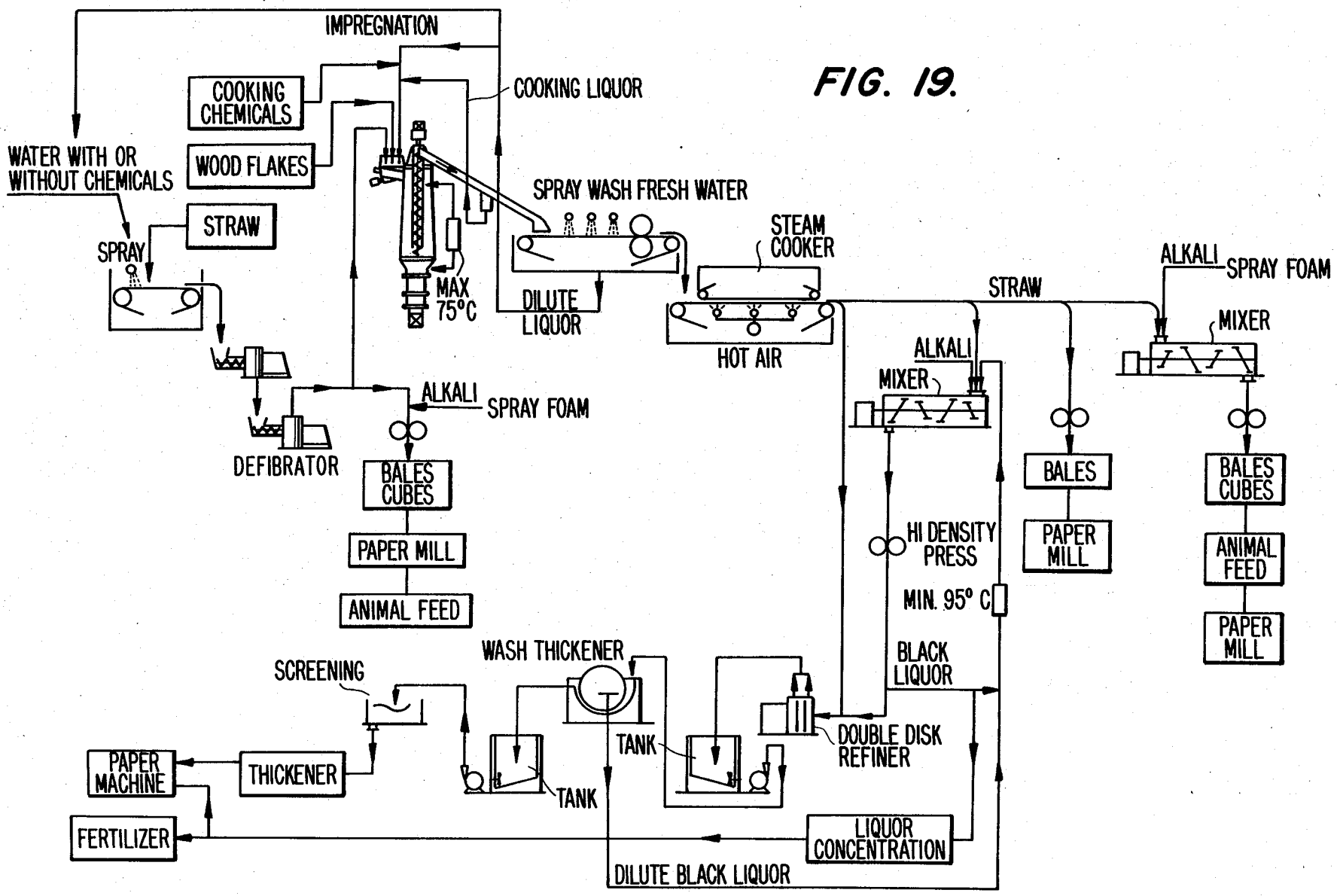

A variety of inexpensive mechanical installations for processing widely varied from present conventional pulping systems becomes not only possible but preferable. Schematic diagrams of two such possibilities are submitted as part of this invention. FIG. 18 shows an ultra simple process involving a modified hydra-pulper for the production of pulp for paper which would provide an economic and viable unit for production levels as low as 10 tons per day. FIG. 19 shows a completely flexible unit for the production of animal feed and for paper pulp utilizing hot air to achieve rapid, sufficient nitration reaction temperatures (100° C.) and the drying of the end product to a specific moisture level, as necessary.

The choice between the use of nitrate salts vs. nitric acid would be dictated by economics: (1) Twice as much salt would be necessary to achieve the same level of delignification as with nitric acid which is generally low in cost. (2) The reduced capital investment by using salts, since stainless steel would not be required for processing equipment. (3) The desired chemical content of the black liquor is provided, e.g., sodium ion built up in the soils if used for fertilizer would not be acceptable. (4) Differences in acceptability and digestibility by various animals' digestive system or the chemical requirements needed for further processing of the residual black liquor into sizing, binders or resin extenders.

The ability to spray or foam the nitrating liquid on dry agricultural residues makes possible a process that is essentially dry and permits the surface leaching out of the nitrated lignin after the alkaline liquor is added by spray or foam (an action that can be simultaneous with or follow immediately after the nitrating stage) when the mass (10–15% moisture after drying if necessary) is subjected to heat and pressure. Enough surface lignin is released to provide a binding material sufficient to bind the shredded material. When it is then subjected to an appropriate hardening agent such as alum, which also provides water resistance and within the usual pressures and temperatures used in the manufacture of flake or particle board derived from wood residues, inexpensive, water resistant building board, packaging board or fuel briquettes can be made from any defibered, flaked or chipped material by generating its own binding materials, eliminating or reducing the use of expensive resins such as phenolics.

The following examples are given as illustrations of the present invention, although it is not intended that they limit its scope in any way.

EXAMPLE 1

Shredded wheat straw or barley straw with 22% moisture is fed into a covered, non-pressure hydrapulper in which water in the weight ratio of 9:1 of the air dry straw is circulating with a temperature of 70° C. $NH_4NO_3$ is added equal to 0.125% of the B.D. (bone dry) straw and the solution is adjusted to pH 13.5 with NaOH. The mixture is allowed to digest for 90 minutes, holding the temperature at 70° C., then drained of black liquor or passed through a high density press and then defibered as required. At this point the fiber can be washed of residual chemical, and have its pH adjusted to 6.5 with acid and alum, and followed by normal paper making procedure. Washing is not necessary—but additional neutralizing acid will be required to offset residual alkali in the fiber.

EXAMPLE 2

The above raw material and conditions, substituting the $HNO_3$—$Al_2(SO_4)_3$ solution for $NH_4NO_3$ in an amount equivalent to 0.10% to the B.D. straw for 60 minutes. Test results, which are equivalent to semi-chemical corrugating board made from wood, are for a 115 gr. sheet Concora (CMT 30) kg./cm.$^2$: 25.6
Burst (Mullen) Kpa: 385

EXAMPLE 3

Spruce wood chips in the amount of 1300 gr. AD. (air dry), equivalent to 1000 gr. B.D., are immersed in a cooking solution of 5000 cc and held at 100° C. in a closed non-pressure container for 90 minutes. The cooking liquor is made up of 0.75% of $HNO_3$—$Al_2(SO_4)_3$ to the B.D. wood together with 7.5% of NaOH to the B.D. fiber or 1.5% concentration as a solution. The black liquor is drained from the chips and recycled to chemical exhaustion. The fiber is soft and very light in colour although the Kappa No. of 125 shows a relatively low percentage of delignification. Test results on defibered, screened pulp were as follows:

| Test | | Base Sheet | Black Liquor Solids Added 2.82% |
|---|---|---|---|
| Basis Weight | gr./m$^2$ | 117 | 128 |
| Schopper Regler | Degree | 43 | 43 |
| Apparent Density | gr/cm$^3$ | 0.513 | 0.512 |
| Burst | Kpa | 271 | 370 |
| Elmendorf Tear | mN | 1185 | 1154 |
| Tensile | Mtr | 4400 | 4625 |
| Elongation | % | 1.85 | 2.55 |
| Ring Crush C.D. | Kn/m | 1.20 | 1.03 |
| M.D. | Kn/m | 1.47 | 1.14 |

The black liquor solids were added to the pulp in dilute suspension and precipitated on the fiber by adjusting the pH to 6.2 with alum.

EXAMPLE 4

Spruce wood chips were cooked in a covered non-pressure vessel—hydrapulper—under the following conditions:

| | |
|---|---|
| $HNO_3$ $Al_2(SO_4)_3$ Stage | |
| Concentration | 3.8% |
| Time | 60 Minutes |
| Temperature | 95°–100° C. |
| Drain and Wash | Recycle |
| NaOH Stage | |
| pH Level | 12.5 |
| Time | 30 Minutes |
| Temperature | 95°–100° C. |
| Drain | Recycle |

Test results after defibering, screening and refining were:

| | |
|---|---|
| Bond Dry Yield | 70.5% |
| Kappa No. | 65 |
| Initial Schopper Regler | 15° |
| Final Schopper Regler | 30° |
| Basis Weight | 137 gr/m$^2$ |
| Apparent Desity | 0.694 gr/cm$^3$ |
| Burst | 6.2 Kpa |
| Elmendorf Tear | 2060 mN |
| Tensile | 5009 m |
| Elongation | 2.94% |
| Double Fold | 2140 |
| Ring Crush | 1.62 Kn/m |

EXAMPLE 5

Rice straw was cooked in the two stage acid-alkali process in varying percentage concentration of $HNO_3$—$Al_2(SO_4)_3$ under the following conditions: closed, non-pressure, rotating vessel, operating at 95°–100° C. Time to temperature each sequence 10 minutes—total cooking time: 30 minutes with intervening wash cycle. Alkali stage pH 11.5.

Test results after defibering—refining, but no screening, were as follows:

| Trial | 1 | 2 | 3 |
|---|---|---|---|
| Acid Concentration % | 1.00 | 0.50 | 0.25 |
| Unbleached Yield % | 39.6 | 52.4 | 57.9 |
| Bleached Yield % | 35.6 | 46.3 | 49.7 |
| Initial G.E. Brightness | 43 | 39 | 27 |
| Final G.E. Brightness | 80 | 80 | 73 |
| Kappa No. | 8.5 | 20.2 | 34.5 |
| Ash % | 1.6 | 11.2 | 11.1 |
| Alpha Cellulose % | 83.2 | 67.9 | 52.0 |
| Holo Cellulose % | 95.9 | 79.5 | 74.7 |
| Schopper Regler° | 40 | 56 | 62 |
| Basis Weight gr/m$^2$ | 61.0 | 59.2 | 62.6 |
| Burst | 261 | 361 | 124 |

EXAMPLE 6

Defibered cotton stalks, coppice willow or similar growth bushes or grassy materials as straw are intimately mixed with neutral pH black liquor solids from the instant process in an amount of 10–35% of the dry fibrous material and the mixtures dried in a rotary dryer to 10–15% moisture content. Paper-maker's alum is added to bring the pH down to 4.5–5.5 and the moisture content controlled to 7–10% and the mixture subjected to pressure of 60 kg/cm$^2$ and 150° C. to form panel board in the usual manner of manufacturing wood flake or particle board.

EXAMPLE 7

Defibered cotton stalks, coppice willow or similar growth bushes or grassy materials as straw, containing 30–40% moisture, are sprayed or foamed to achieve an intimate wetting with a mixed solution of $HNO_3$—$Al_2(SO_4)_3$ and NaOH using, relative to a B.D. fiber, 0.50% acid and 1.5% NaOH to produce a pH of 12 in the mixture at 50% moisture content.

The mixture is subjected to a cooking/digesting temperature of 135° C. and 65 Psi for 5–7 minutes which will release solubilized surface lignin on the fibrous structures. After digestion the mixture is sprayed with mineral acid to bring the pH to 7.0 and then an alum solution is applied concurrently or subsequently to bring the pH to 4.5–5.5. The mixture is then dried to 7–10% moisture in a rotary drier and then run over a continuous solid fiber board machine with heat and pressure to produce packaging board 2–6 mm in thickness.

EXAMPLE 8

Southern pine wood flakes, cut tangentially to the log circumference to a thickness of about 0.6 mm, are continuously fed into a screw conveyor. The wood has a lignin content of about 35 wt. %. As shown in FIG. 1, the flakes are submerged and cooked in about six times their weight of a solution of 5 weight percent nitric acid to which has been added aluminum sulphate in the ratio of 1 part aluminum sulphate to 10 parts $HNO_3$ for a period of about 15 minutes at a temperature of about 95° C. The slurry of flakes in acid is then fed into a rotary screen where the flakes are drained of the acid being washed with a minimal amount of hot water. The drained excess acid and wash water are combined, fortified with alum and concentrated nitric acid, as needed, and recycled for use in the initial nitration step. The flakes are then conducted to a storage vessel, from which they are fed into a screw conveyor, containing about six times their weight of a solution of about 0.5 weight percent sodium hydroxide, giving a pH of 12–13, at a temperature of about 95° C. There they are cooked for about 15 minutes. The flakes, partially defibered, are drained of the alkaline solution (in which the lignin-nitrate has dissolved) for its recycling or purging with a rotary screen, then put through a defibrator in order to separate the fibers, following which they are washed in a rotary washer with a minimal amount of hot water. The black liquor that is drained off in the rotary screen is recycled to the lignin extraction step.

In order to obtain a product with a higher degree of cellulose purity, i.e., bleachable pulp, not necessary of linerboard grade pulp, the nitration and digestion steps can be repeated. To do so, the semi-pulped flakes are fed into a screw conveyor 17 which contains about six times their weight of a solution of about 1.5 weight percent nitric acid to which aluminum sulfate has been added in the ratio of about 1 part to 10 parts $HNO_3$. There the semi-pulped flakes are cooked for a period of about 15 minutes at a temperature of about 95° C. The semi-pulp is then drained of excess acid and washed with a minimal amount of hot water in a rotary dryer 18. The drain acid and wash water are combined and recycled to the second nitration step. The semi-pulp is then fed into a screw conveyor 19 which contains about six times its weight of a solution of about 0.8 weight percent sodium hydroxide. The semi-pulp is there cooked for about 10 minutes at a temperature of about 95° C. The semi-pulp is then drained of the excess alkaline solution (black liquor) in a high density press 20, after which it is fed into a defibrator 21 for additional defibering, and finally washed in a rotary washer 22 with a minimal amount of hot water. The black liquor removed from the press 20 is partially recycled to the screw conveyor 19 for reuse, with the remaining portion being sent to waste disposal. The alkaline wash water from rotary washer 22 is also recycled to the second extraction step.

The pulp leaving the rotary washer has been delignified to the extent required and defiberized. It is then screened by conventional screeening equipment to remove oversized particles which have not been defiberized, which are returned to the nitration step for reprocessing.

EXAMPLES 9–15

The process of Example 8 is repeated, using different ligno-cellulosic raw materials, as indicated in the following table 3. In each example, the nitric acid contains 1 part aluminum sulfate for each 10 parts of $HNO_3$. In Examples 13 and 14, where paper waste is used, the ligno-cellulosic material is subjected to only one nitration extraction sequence.

TABLE 3

| Example | Ligno-Cellulosic Fibrous Material | Lignin in Fibrous Material, Wt. % | FIRST SEQUENCE Nitric Acid $HNO_3$ Strength, Wt. % | Nitric Acid Wt. Ratio, Acid to Fibrous Material | Sodium Hydroxide NaOH Strength, Wt. % | Sodium Hydroxide Wt. Ratio, Base to Fibrous Material |
|---|---|---|---|---|---|---|
| 9 | Spruce (Norway) (0.5 mm. flakes) | 33 | 4.4 | 4:1 | 0.3 | 5:1 |
| 10 | Beech (0.8 mm. flakes) | 23 | 3:2 | 4:1 | 0.3 | 5:1 |
| 11 | Bagasse (screened) | 19 | 0.8 | 7:1 | 0.2 | 6:1 |
| 12 | Straw (chopped) | 16 | 0.5 | 10:1 | 0.1 | 15:1 |
| 13 | Newsprint waste (pulped) | 25 | 0.5 | 15:1 | 0.1 | 15:1 |
| 14 | Corrugated waste (pulped) | 20 | 0.5 | 15:1 | 0.1 | 15:1 |
| 15 | Bamboo | 24 | 3.0 | 4:1 | 0.2 | 3:1 |

| Example | Ligno-Cellulosic Fibrous Material | SECOND SEQUENCE Nitric Acid $HNO_3$ Strength, Wt. % | Nitric Acid Wt. Ratio, Acid to Fibrous Material | Sodium Hydroxide NaOH Strength, Wt. % | Sodium Hydroxide Wt. Ratio, Base to Fibrous Material | Approxi Total C Usage, of Fibe Nitric Acid |
|---|---|---|---|---|---|---|
| 9 | Spruce (Norway) (0.5 mm. flakes) | 1.5 | 4:1 | 0.1 | 5:1 | 3.0 |
| 10 | Beech (0.8 mm. flakes) | 1.1 | 4:1 | 0.1 | 5:1 | 3.0 |
| 11 | Bagasse (screened) | 0.3 | 4:1 | 0.1 | 6:1 | 3.0 |
| 12 | Straw (chopped) | 0.2 | 7:1 | 0.05 | 10:1 | 3.0 |
| 13 | Newsprint waste (pulped) | — | — | — | — | |
| 14 | Corrugated waste (pulped) | — | — | — | — | |
| 15 | Bamboo | 1.0 | 4:1 | 0.1 | 2.5:1 | 3.0 |

EXAMPLE 16

U.S. Southern pine containing about 35 wt. % lignin is used as the raw material. The logs are flaked by cutting tangentially to the log circumference to a thickness of about 0.5 mm. The flakes are continuously fed into a screw conveyor 10, as shown in FIG. 1B where the flakes are submerged and cooked in a solution of 5 weight percent nitric acid to which has been added aluminum sulfate in the ratio of 1 part aluminum sulfate to 10 parts nitric acid, for a period of about 15 minutes at a temperature of about 95° C. The slurry of flakes in acid is then fed into a rotary dryer 11 where the flakes are drained of the acid and then washed with a minimal amount of hot water. The drained excess acid and wash water are combined, fortified with concentrated nitric acid, as needed, and recycled for use in the first nitration step. The flakes are then fed into a screw conveyor 12 containing a solution of about 1.5 wt. % sodium hydroxide at a temperature of about 95° C. and are there cooked for about 15 minutes. In rotary dryer 13 the flakes are drained of the alkaline solution ("black liquor") into which the lignin-nitrate has been extracted, following which they are put through a defibrator 14 in order to separate the fibers partially. Then they are washed in a rotary washer 15 with a minimal amount of hot water. The wash water is recycled to the first extraction step.

In order to obtain a product with a degree of cellulose purity which is higher than that required for linerboard grade pulp, i.e., easily bleachable, the nitration and extraction steps can be repeated. To do so, the semi-pulped flakes are fed into a screw conveyor 20 which contains a solution of about 1.5 weight percent nitric acid to which aluminum sulfate has been added in the ratio of about 1 part to 10 parts nitric acid, and are again cooked for a period of about 15 minutes at a temperature of about 95° C. The semi-pulp is then drained of excess acid and is washed with a minimal amount of hot water in a rotary dryer 21. The drained acid and wash water are combined and recycled to the second nitration step. The washed semi-pulp is fed to a screw conveyor 22 which contains a solution of about 0.8 weight percent sodium hydroxide. The semi-pulp is there cooked for about 5 minutes at a temperature of about 95° C. The semi-pulp is then drained of the excess alkaline solution in a high density press 23. The drain solution is recycled to the second extraction step. The semi-pulped fibrous structure is fed into a defibrator 24 for final defibering, following which it is washed in a rotary washer 25 with a minimal amount of hot water. The wash water is recycled to the second extraction step. At this stage, the flakes have been almost completely defiberized and the lignin has been extracted. The resulting separated cellulosic pulp is then screened over conventional screening equipment 26 to remove oversize particles which have not been defiberized, those particles then being returned to the first nitration step for reprocessing.

After the process has been started up and the amount of solids dissolved in the black liquor that is drained off at drain 13 and press 23 reaches about 20 weight percent, a portion, e.g., about 25 percent, of the lignin-containing extraction liquor is continuously fed into precipitator 40. Dilute nitric acid of about 1.5 weight percent strength is then added to the black liquor until a pH of about 6 is obtained, at which point most of the ligneous component will have precipitated as an amorphous solid. The precipitated ligneous component is drained of the mother liquor in the precipitator 40. The separated mother liquor is recycled to the first nitration step.

The precipitated ligneous component is dried in an evaporator 42, after which it can be stored or transported for later use. Alternatively, the black liquor can be mixed with nitric acid in a settling basin 41, in which the ligneous sludge on the bottom can be separated from the clear mother liquor which overflows the top.

At time of use in the making of paperboard, the ligneous material is redissolved in aqueous sodium hydroxide (pH of 7.5) in vessel 43, and the resulting solution is conducted to the paper machine fan pump 30, where it is mixed with the pulp cellulosic fibers from screen 26 and with sufficient papermaker's alum to hold the pH of the mixture to within the range of about 6.0 to 6.5. The amount of ligneous solution mixed into the pulp is such that the pulp contains about 25% ligneous material, based on the solids content of the pulp. The lignin-containing pulp is then sent to the headbox of paper machine 31 and is used to make paperboard.

EXAMPLES 17–23

The process of Example 16 is repeated, using different ligno-cellulosic raw materials, as indicated in Table 4, where the percentages are by weight.

EXAMPLE 24

The process of Example 16 is repeated in all respects, except that a portion (about 15 weight percent) of the lignin-containing extraction liquor from drain 13 and press 23 is added directly to the screened cellulosic fibers at the fan pump 30 of the paper machine, directly before the headbox. The remaining portion of the lignin-containing extraction liquor is recycled to the first and second extraction steps.

EXAMPLES 25–30

The process of Example 8 is repeated, using different ligno-cellulosic raw materials, as indicated in the following Table 5.

In each example the nitric acid contains 1 part aluminum sulphate for each 10 parts of $HNO_3$.

In Examples 27 through 30 the ligno-cellulosic material is subjected to only one nitration-extraction sequence.

TABLE 4

| | | | FIRST SERIES | | | | SECOND SERIES | | | |
|---|---|---|---|---|---|---|---|---|---|---|
| | | | Nitric Acid | | Sodium Hydroxide | | Nitric Acid | | Sodium Hydroxide | |
| Example | Ligno-Cellulosic Fibrous Material | Lignin in Fibrous Material, Wt. % | $HNO_3$ Strength, Wt. % | Wt. Ratio, Acid to Fibrous Material | NaOH Strength, Wt. % | Wt. Ratio, Base to Fibrous Material | $HNO_3$ Strength, Wt. % | Wt. Ratio, Acid to Fibrous Material | NaOH Strength, Wt. % | Wt. Ratio, Base to Fibrous Material |
| 17 | Spruce (Norway) (0.5 mm flakes) | 33 | 4.4 | 4:1 | 1.0 | 3:1 | 1.5 | 2.5:1 | 0.7 | 2.5:1 |
| 18 | Beech (0.8 mm flakes) | 23 | 3.2 | 4:1 | 0.8 | 3:1 | 1.1 | 2.5:1 | 0.5 | 2.5:1 |
| 19 | Bagasse (screened) | 19 | 0.8 | 10:1 | 0.5 | 8:1 | 0.3 | 4:1 | 0.3 | 4:1 |
| 20 | Straw (chopped) | 16 | 0.5 | 15:1 | 0.3 | 15:1 | 0.3 | 7:1 | 0.2 | 7:1 |
| 21 | Newsprint waste (pulped) | 25 | 1.5 | 15:1 | 0.7 | 15:1 | — | | — | |
| 22 | Corugated waste (pulped) | 20 | 1.0 | 15:1 | 0.6 | 15:1 | — | | — | |
| 23 | Bamboo | 24 | 3.0 | 4:1 | 0.7 | 3:1 | 1.0 | 2.5:1 | 0.4 | 2.5:1 |

TABLE 5

| | | | First Sequence | | | |
|---|---|---|---|---|---|---|
| | | | Nitric Acid | | Sodium Hydroxide | |
| Example | Ligno-Cellulosic Fibrous Material | Lignin in Fibrous Material, Wt. % | $HNO_3$ Strength, Wt. % | Wt. Ratio, Acid to Fibrous Material | NaOH Strength, Wt. % | Wt. Ratio, Base to Fibrous Material |
| 25 | Spruce (Norway) (0.5 mm flakes) | 33 | 4.4 | 4:1 | 0.3 | 5:1 |
| 26 | Beech (0.8 mm flakes) | 23 | 3.2 | 4:1 | 0.3 | 5:1 |
| 27 | Bagasse (screened) | 19 | 1.5 | 7:1 | 0.2 | 20:1 |
| 28 | Straw (shredded) | 16 | 1.5 | 10:1 | 0.1 | 20:1 |
| 29 | Newsprint waste (pulped) | 25 | 1.0 | 15:1 | 0.2 | 20:1 |
| 30 | Bamboo (flaked) | 24 | 3.0 | 5:1 | 0.2 | 20:1 |

| | | Second Sequence | | | | Approximate Total Chemical Usage, | |
|---|---|---|---|---|---|---|---|
| | | Nitric Acid | | Sodium Hydroxide | | | |
| Example | Ligno-Cellulosic Fibrous Material | $HNO_3$ Strength, Wt. % | Wt. Ratio, Acids to Fibrous Material | NaOH Strength, Wt. % | Wt. Ratio, Base to Fibrous Material | Wt. % of Nitric Acid | Fibre Used Alkali |
| 25 | Spruce (Norway) (0.5 mm flakes) | 1.5 | 8:1 | 0.1 | 20:1 | 5.0 | 2.0 |
| 26 | Beech (0.8 mm flakes) | 1.1 | 8:1 | 0.1 | 20:1 | 4.5 | 2.0 |
| 27 | Bagasse (screened) | — | — | — | — | 4.0 | 1.8 |
| 28 | Straw | — | — | — | — | 4.0 | 1.8 |

TABLE 5-continued

| | | | | | | | |
|---|---|---|---|---|---|---|---|
| | (shredded) | | | | | | |
| 29 | Newsprint waste (pulped) | — | — | — | — | 8.0 | 3.0 |
| 30 | Bamboo (flaked) | — | — | — | — | 4.0 | 1.6 |

EXAMPLE 31

This example simulates the use of a sulphite digester producing bleachable pulp (Kappa No. 8) using pressure under conditions as follows:

| | |
|---|---|
| Wood | Spruce |
| Form | Flakes 0.5–0.6 mm. thick |
| Charge | 1.3 kg. (dry) |
| Digester | Stationary circulating |
| Impregnation Time | 15 minutes |
| Impregnation Temperature | 70° C. |
| Impregnaton Chemical Concentration | 5% $HNO_3$ |
| Cooking Time | 15 Minutes |
| Time to Cooking Temperature | 2 Minutes |
| Cooking Temperature | 85–95° C. |
| Cooking Chemical | 7.5% $HNO_3$ |
| Ratio Liquor to dry wood | 4:1 |
| Pressure | 7–22 p.s.i.g. |
| Gas off | None |
| Delignification Stage | 20 Minutes |
| Delignification Temperature | 95–100° C. |
| Delignification Chemical | 0.25% NaOH |
| Delignification pH | Starting 12 |

Test results on the paper produced were as follows:

| Test | Refining Minutes 0 | 5 | 7 | 10 | 13 |
|---|---|---|---|---|---|
| Freeness, °SR | 21 | 27 | 39 | 46 | 52 |
| Basis Weight, gr/m2 | 81.7 | 80.9 | 78.5 | 80.0 | 80.9 |
| Caliper, mm | 0.115 | 0.100 | 0.094 | 0.089 | 0.089 |
| Apparent Density, kg/cm3 | 0.710 | 0.809 | 0.835 | 0.899 | 0.909 |
| Elongation % | 1.9 | 2.9 | 2.8 | 2.7 | 3.2 |
| Tensile Strength, Mtr | 6600 | 7400 | 7360 | 7480 | 8240 |
| Mullen Abs, Kpg | 258 | 360 | 324 | 312 | 380 |
| Mullen Index, Kpa | 316 | 444 | 412 | 390 | 470 |
| Tear - Brecht-Imset, Mn | 1118 | 1187 | 942 | 922 | 1109 |

EXAMPLE 32

A non-pressure process using low concentration circulated chemical and longer times producing linerboard pulp, Kappa No. 37 used the following conditions:

| | |
|---|---|
| Wood | Spruce Flakes, 0.5–0.6 mm |
| Charge | 1.3 kg, dry |
| Impregnation Time | 30 Minutes |
| Impregnation Temperature | 50° C. |
| Impregnation Chemical | 0.5% $HNO_2$ Solution |
| Cooking Time | 45 Minutes |
| Cooking Temperature | 95° C. |
| Cooking Chemical | 1.8% $HNO_3$ Solution |
| Ratio of Liquor to dry Wood | 6 |
| Delignification Chemical | NaOH |
| Delignification pH | Starting 12 |

EXAMPLE 33

A non-pressure process using a hydrapulper producing an animal feed grade of straw:

| | |
|---|---|
| Wheat Straw | Mechanically shredded |
| Charge | 1.2 kg, dry |
| Impregnation Time | 15 Minutes |
| Impregnation Temperature | 50° C. |
| Impregnation Chemical | 0.05% $HNO_3$ Solution |
| Ratio of Impregnation Chemical to dry Charge | 0.6% |
| Cooking Time | 15 Minutes |
| Cooking Temperature | 95° C. |
| Cooking Chemical | 0.15% $HNO_3$ Solution |
| Ratio of Cooking Chemical to dry Charge | 1.5% |
| Delignification | NaOH, pH 12, 95° C. |

EXAMPLE 34

A spray storage system for straw to produce pulp for packaging papers:

| | |
|---|---|
| Wheat Straw | Mechanically shredded |
| Starting Moisture | 12% (before spraying) |
| Finishing Moisture | 35% |
| Chemical sprayed | 3% $HNO_3$ (100%) of dry fiber wt |
| Heat applied | None |
| Storage Period | Six Months |
| Delignification | NaOH, pH 12 |
| Delignification Time | 10 Minutes |
| Delignification Temperature | 50° C. |

EXAMPLE 35

A non-pressure process using an open hydrapulper producing a semi-chemical type pulp for use as corrugating medium combined with waste fiber and straw black liquor (lignin) solids.

| | |
|---|---|
| Wheat Straw | Mechanically shredded |
| Charge | 1.2 kg atro |
| Impregnation Time | 15 Minutes |
| Impregnation Chemical | 0.05% $HNO_3$ conc. |
| Ratio of Impregnation Chemical to Charge | 0.6% |
| Impregnation Temperature | 50° C. |
| Cooking Time | 30 Minutes |
| Cooking Chemical | 0.15% $HNO_3$ conc. |

-continued

| | |
|---|---|
| Cooking Temperature | 95° C. |
| Ratio of Cooking Chemical to Charge | 1.5% |
| Delignification | 15 Minutes, NaOH to pH12, 95° C. |
| Board Composition | |
| Defibered unscreened Pulp | 47% |
| Mixed Waste Fiber | 38% |
| Unmodified Lignin Solids | 15% |
| Test Results - Produced on Paper Machine | |
| Basis Weight, gr/m2 | 105 |
| Mullen Index, Kpa | 233 |
| Elmendorf Tear, Md/Cd/Mn | 812/859 |
| Concora, Kgp | 158 |

EXAMPLE 36

A non-pressure neutral pH-cooking process using an open hydrapulper producing a packaging paper pulp.

| | |
|---|---|
| BAGASSE | SCREENED - DEPITHED |
| CHARGE | 1.2 Kg. Dry |
| COOKING TIME | 15 MINUTES |
| COOKING CHEMICAL | $NaNO_3$ 0.5% SOLUTION PLUS NaOH to pH 12 |
| RATIO OF COOKING CHEMICAL TO CHARGE | 6.25 |
| COOKING TEMPERATURE | 95–100° C. |
| DELIGNIFICATION | 30 MINUTES, NaOH to pH 12, 95° C. |

EXAMPLE 37

Coppice willow is used as the raw material. The coppice willow is chopped and shredded to obtain uniformity of size of the fibrous structure. As presented in Table 6 the coppice willow is nitrated with an aqueous solution of one part aluminum sulphate to 10 parts of $HNO_3$ (100%) the nitrating solution having a chemical concentration of from 1 to 3.5% at a temperature of from 95° to 100° C. for times varying from 15 to 25 minutes. The end pH of the alkaline extraction liquor using NaOH varies from 7 to 11.

Additionally as presented in Table 6, the coppice willow pulp with an equivalent weight portion of black liquor was added to a varying percentage of mixed corrugated waste to form hand pressed sheets; the physical properties of these sheets are presented in Table 6.

TABLE 6

PULPING OF COPPICE WILLOW

| | A | B | C | | |
|---|---|---|---|---|---|
| Cook Conditions - Shredded Coppice Willow | | | | | |
| Cook | None | None | None | | |
| Impregnation - Steaming Charge | 200 gr. | 200 gr. | 200 gr. | | |
| Time - Minutes | 15 | 20 | 25 | | |
| Temperature °C. | 95–100 | 95–100 | 95–100 | | |
| Nitrating Agent | 1.0 | 2.5 | 3.5 | | |
| Ratio of Nitrating Agent to Charge | 6.0% | 15.0% | 21.0% | | |
| Ending pH with NaOH | 11 | 7 | 7 | | |
| Hand Sheet Test Results - Unwashed Pulp - Recycled Black Liquor | | | | | |
| Percent Mixed Corrugated Waste | 100 | 75 | 50 | 25 | 0 |
| Percent Coppice Willow Pulp* | 0 | 25 | 50 | 75 | 100 |
| Cook B - pH 6 | | | | | |
| Basis Weight - gr/m2 | 141 | 131 | 129 | 135 | 135 |
| Apparent Density - gr/m3 | 643 | 505 | 460 | 381 | 357 |
| Concora (30 Min. 20° C. 65% RH) | 19.6 | 15.3 | 13.2 | 14.2 | 14.9 |
| Mullen - kg/cm2 | 4.2 | 3.2 | 1.1 | 0.8 | 0.4 |
| Cook C - pH 6 | | | | | |
| Basis Weight - gr/m2 | 141 | 131 | 127 | 127 | 137 |
| Apparent Density - gr/m3 | 643 | 595 | 635 | 652 | 760 |
| Concora (30 Min. 20° C. 65% RH) | 19.6 | 18.0 | 18.7 | 20.0 | 22.4 |
| Mullen - kg/cm2 | 4.2 | 4.0 | 2.4 | 1.5 | 1.1 |
| Cobb Size 60 - gr/m2 | — | — | 153+ | — | — |
| Cook C - pH 5 | | | | | |
| Basic Weight - gr/m2 | 14 | 135 | 132 | 132 | — |
| Apparent Density - gr/m3 | 4.5 | 610 | 640 | 650 | — |
| Concora (30 Min. 20° C. 65% RH) | 19.6 | 21.3 | 20.2 | 20.9 | — |
| Mullen - kg/cm2 | 4.2 | 4.4 | 2.9 | 1.4 | — |
| Cobb size 60 - gr/m2 | — | — | 55 | — | — |

EXAMPLE 38

A non-pressure process using an open hydrapulper producing a bleachable straw pulp.

| | |
|---|---|
| WHEAT STRAW | MECHANICALLY SHREDDED |
| CHARGE | 1.2 Kg ATRO |
| IMPREGNATION TIME | 15 MINUTES |
| IMPREGNATION CHEMICAL | 0.5% $HNO_3$ CONC. |
| RATIO OF IMPREGNATION CHEMICAL TO CHARGE | 6.25% |
| IMPREGNATION TEMPERATURE | 50° C. |
| COOKING TIME | 15 MINUTES |
| COOKING CHEMICAL | 1.5% $HNO_3$ CONC. |
| RATIO OF COOKING CHEMICAL TO CHARGE | 12.5% |
| COOKING TEMPERATURE | 95° C. |
| DELIGNIFICATION | 15 MINUTES, NaOH to pH 12–95° C. |
| Test Results-Produced on Paper Machine | |
| BASIS WEIGHT, GR/M$^2$ | 180 |
| MULLEN INDEX, KPA | 495 |
| ELMENDORF TEAR, MD/CD-MN | 887/1018 |
| SCHOPPER RIEGLER, DEGREES | 50 |
| KAPPA, NO. | 16 |

Electron micrographs of illustrative cellulosic fibers produced by the process of the present invention are shown in FIGS. 2 through 17. In each instance sodium hydroxide was used as the alkaline extraction agent and both the nitration step and the extraction step were conducted at temperatures within the range of about 95° to 100° C. at atmospheric pressure in a hydrapulper. Final defibering was performed for two minutes in a blender; then the pulp was submitted to rough screening. The excellent length and structure of the fibers are apparent from the micrographs.

Figure 6:
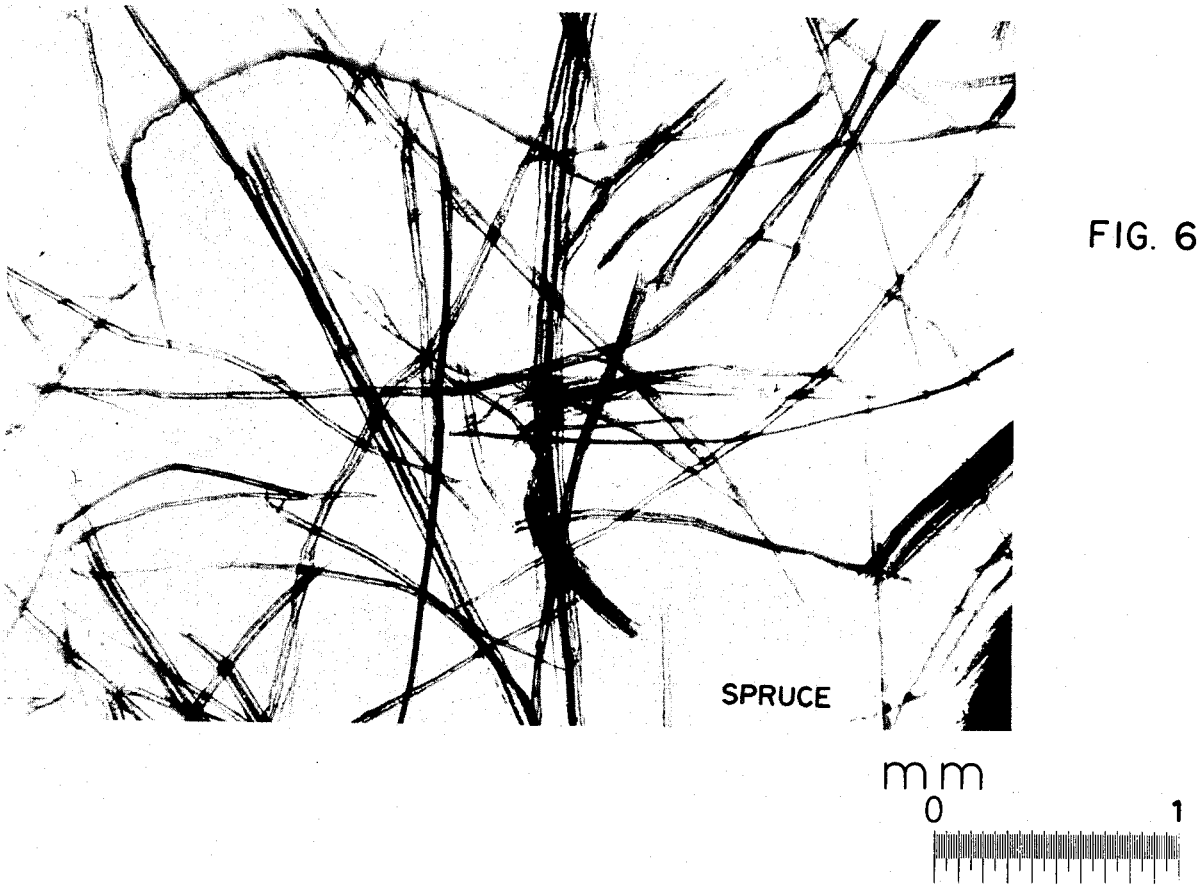
Figure 7:
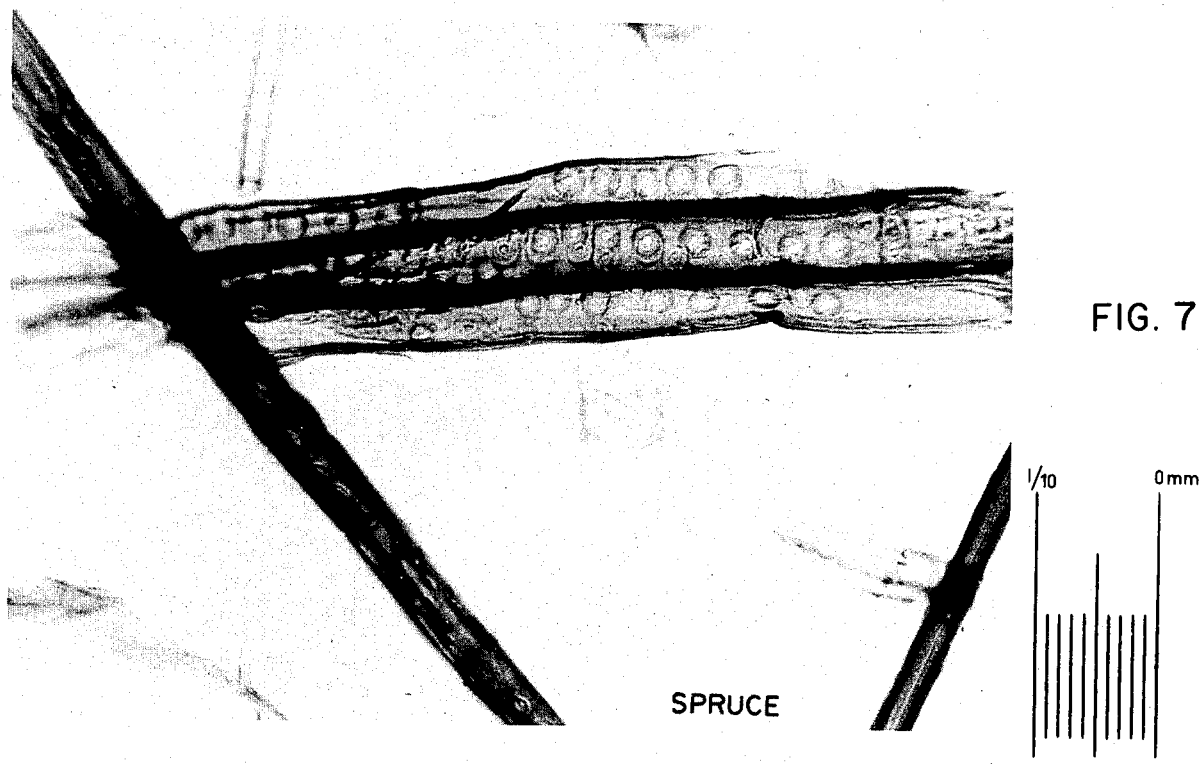

FIGS. 2 and 3 are electron micrographs of fibers from U.S. Southern pine which had been subjected to a total nitration-extraction time (total for both steps) of 25 minutes, while FIGS. 4 and 5 show such pine fibers after only a 20 minute nitrate-extraction time. FIGS. 6 and 7 are micrographs of fibers of spruce which had been subjected to a nitration-extraction time of 25 minutes. FIGS. 8 and 9 show bagasse fibers after a nitration-extraction time of 25 minutes. FIGS. 10 and 11 show wheat straw fibers after a nitration-extraction time of 25 minutes. FIGS. 12 and 13 are micrographs of beech fibers obtained from the present process using a combined nitration-extraction time of 27.5 minutes. FIGS. 14 and 15 are photomicrographs of bamboo fibers after a nitration-extraction time of 30 minutes. FIG. 16 shows fibers from waste newsprint after a nitration-extraction time of 15 minutes. FIG. 17 is a photomicrograph of fibers resulting from subjecting waste corrugated boxes to the nitration-extraction process for 15 minutes.

What is claimed is:

1. In a process for treating fibrous, ligno-cellulose material to form softened, defibered chemical cellulose pulp which comprises:

(a) contacting said ligno-cellulose material with an aqueous solution of a nitrate ion source to nitrate the ligneous component of said material, (b) contacting the nitrated material produced in step (a) with an alkaline extraction liquor to extract the nitrated ligneous component to provide softened, partially defibered cellulosic structures, and (c) completely defibering said partially defibered cellulosic material the improvements wherein an aluminum compound is added to the solution of the nitrate ion source in an amount sufficient to accelerate the nitration of the lignin and the process is carried out at atmospheric pressure and at temperatures below about 110° C.

2. A process according to claim 1 wherein an aqueous nitric acid solution containing an aluminum compound is used to nitrate the ligneous component of said ligno-cellulose material, then the nitrated material is separated from said solution, and contacted with an alkaline extraction liquor to extract the nitrated lignin.

3. The process of claim 2 wherein the alkaline extraction liquor is an aqueous solution of sodium hydroxide, potassium hydroxide, or ammonium hydroxide containing about 0.1 to 1.5 weight percent NaOH, KOH or $NH_4OH$.

4. The process of claim 3 wherein the fibrous ligno-cellulosic material is contacted with the nitric acid at a temperature of about 75° to 110° C.

5. The process of claim 4 wherein the nitrated ligno-cellulosic material is cooked in the alkaline extraction liquor at a temperature of about 75° to 100° C.

6. The process of claim 5 wherein both the contacting step and the cooking step are conducted under approximately atmospheric pressure conditions and the $HNO_3$ concentration in the contacting step is about 0.3 to 5.5 percent by weight.

7. The process of claim 4 wherein the fibrous ligno-cellulosic material is contacted in the nitric acid for about 5 to 30 minutes.

8. The process of claim 7 wherein the fibrous ligno-cellulosic material is woody material, grassy material, or waste paper containing uncooked or semi-cooked fibers.

9. The process of claim 8 wherein the fibrous ligno-cellulosic material is woody material.

10. The process of claim 9 wherein the woody material is in the form of wood flakes having a thickness with the range of about 0.3 to 0.8 millimeter.

11. A process according to claim 2 wherein the ligno-cellulose material is nitrated by contacting it with aqueous nitric acid having an $HNO_3$ concentration of about 0.125 to 5.5 weight percent and containing an aluminum compound in an amount of at least 0.01 part by weight of aluminum ions per each 10 parts by weight of $HNO_3$.

12. A process according to claim 11 wherein the aluminum compound is aluminum sulphate which is present in an amount of 0.8 to 1.3 parts per each 10 parts by weight of $HNO_3$.

13. The process of claim 12 wherein the alkaline extraction liquor is an aqueous solution of sodium hydroxide containing about 0.1 to 0.5 weight percent NaOH, the fibrous ligno-cellulosic material is contacted in the nitric acid at a temperature of about 90° to 95° C., and the nitrated ligno-cellulosic material is cooked in the alkaline extraction liquor at a temperature of about 85° to 100° C.

14. The process of claim 13 wherein the fibrous ligno-cellulosic material is contacted in the nitric acid for about 10 to 20 minutes.

15. A process according to claim 11 wherein the $HNO_3$ concentration is about 0.3 to 7.5 weight percent and the aluminum compound is aluminum sulphate which is present in an amount of about 0.8 to 1.3 parts per each 10 parts by weight of $HNO_3$.

16. A process according to claim 1 wherein the nitrating and extraction steps are combined to nitrate and extract the ligneous component of the cellulose material in one alkaline step.

17. A process according to claim 16 wherein the nitrating solution comprises an aqueous solution of $HNO_3$ or nitrate salts selected from the group consisting of sodium nitrate, potassium nitrate, or ammonium nitrate and the contacted ligno-cellulosic material is alkalized to a basic pH of about 11 to 13 to nitrate the ligneous component of said ligno-cellulose material.

18. The process of claim 17 wherein the nitrating solution is sprayed on the ligno-cellulosic material and the lignocellulose material is stored to nitrate the ligneous component of said material during storage.

19. A process in accordance with claim 17 wherein the nitrate ion source comprises 0.10% to 0.75% of the bone dry weight of the ligno-cellulose material treated.

20. A process in accordance with claim 17 wherein the aluminum ion is present in an amount of 0.8 to 1.3 parts per each 10 parts of nitrate ion.

21. A process for treating fibrous ligno-cellulosic material comprising the steps of spraying or foaming a nitrating solution on said ligno-cellulosic material followed by spraying or foaming alkaline liquor in contact with said ligno-cellulosic material to permit release of ligneous binding material in situ upon the application of heat and pressure, wherein the nitrating solution comprises an aqueous solution of a nitrate ion source plus an aluminum compound.

* * * * *